US010457532B2

(12) United States Patent
Jaipaul et al.

(10) Patent No.: US 10,457,532 B2
(45) Date of Patent: Oct. 29, 2019

(54) PNEUMATIC WHEEL LIFT SYNCHRONIZATION

(71) Applicant: Gray Manufacturing Company, Inc., St. Joseph, MO (US)

(72) Inventors: Larry M. Jaipaul, Clarence, NY (US); Seth A. Helmich, Cameron, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 64 days.

(21) Appl. No.: 15/960,284

(22) Filed: Apr. 23, 2018

(65) Prior Publication Data

US 2018/0237278 A1 Aug. 23, 2018

Related U.S. Application Data

(63) Continuation of application No. 14/622,418, filed on Feb. 13, 2015, now Pat. No. 9,950,916.

(60) Provisional application No. 61/970,720, filed on Mar. 26, 2014, provisional application No. 61/942,433, filed on Feb. 20, 2014.

(51) Int. Cl.
*B66F 3/46* (2006.01)
*B66F 7/04* (2006.01)

(52) U.S. Cl.
CPC . *B66F 3/46* (2013.01); *B66F 7/04* (2013.01)

(58) Field of Classification Search
CPC ..... B66F 3/46; B66F 7/04
See application file for complete search history.

(56) References Cited

U.S. PATENT DOCUMENTS 3,595,525 A * 7/1971 Yaste ..... B66F 3/24 254/2 B
4,599,034 A * 7/1986 Kennedy ..... B66F 7/025 254/89 R
4,746,133 A * 5/1988 Hansen ..... B60S 9/12 180/41
5,484,134 A * 1/1996 Francis ..... B66F 7/04 254/2 B
5,649,422 A * 7/1997 Baginski ..... B66F 9/22 60/431
5,911,408 A * 6/1999 Berends ..... B66F 7/04 254/2 B
5,954,160 A * 9/1999 Wells, Sr. ..... B66F 7/28 187/203
6,050,573 A * 4/2000 Kunz ..... B60G 17/005 254/45
6,315,079 B1 * 11/2001 Berends ..... B66F 3/46 187/203
6,634,461 B1 * 10/2003 Baker ..... B66F 3/46 187/210
7,219,770 B2 * 5/2007 Baker ..... B66F 3/46 187/210
7,500,816 B2 * 3/2009 Berends ..... B66F 3/46 187/210

(Continued)

*Primary Examiner* — Marc Carlson
(74) *Attorney, Agent, or Firm* — Hovey Williams LLP

(57) ABSTRACT

A self-synchronizing wheel lift system configured to lift a vehicle using compressed air. The lift system comprises a plurality of pneumatic wheel lifts and a lift control system. The lift control system is configured to automatically synchronize the heights of the wheel lifts during vehicle lifting without causing any of the wheel lifts to completely stop during vehicle lifting.

12 Claims, 14 Drawing Sheets

(56) References Cited

U.S. PATENT DOCUMENTS

| | | | | |
|---|---|---|---|---|
| 8,028,973 | B2 * | 10/2011 | Ford | H02P 6/16 187/203 |
| 8,256,577 | B2 * | 9/2012 | Kritzer | B66F 3/46 187/215 |
| 8,567,761 | B2 * | 10/2013 | De Jong | B66F 3/46 254/134 |
| 9,334,145 | B2 * | 5/2016 | Fagan | B66F 3/46 |
| 2001/0043450 | A1 * | 11/2001 | Seale | F01L 9/04 361/160 |
| 2004/0037653 | A1 * | 2/2004 | Kelso | E02D 27/48 405/236 |
| 2004/0211945 | A1 * | 10/2004 | Maggiori | B66F 3/08 254/89 R |
| 2005/0210713 | A1 * | 9/2005 | Mennen | B25J 9/1628 37/195 |
| 2013/0240300 | A1 * | 9/2013 | Fagan | B66F 3/46 187/210 |
| 2013/0240812 | A1 * | 9/2013 | Helmich | B66F 3/46 254/89 H |
| 2014/0069088 | A1 * | 3/2014 | Faccio | B66C 5/02 60/327 |
| 2015/0232309 | A1 * | 8/2015 | Jaipaul | B66F 7/04 414/800 |
| 2015/0246797 | A1 * | 9/2015 | Jaipaul | B66F 3/46 700/225 |
| 2018/0237278 | A1 * | 8/2018 | Jaipaul | B66F 7/04 |

* cited by examiner

PNEUMATIC WHEEL LIFT SYNCHRONIZATION

RELATED APPLICATIONS

This non-provisional patent application is a continuation patent application to U.S. patent application Ser. No. 14/622,418, filed on Feb. 13, 20105, entitled PNEUMATIC WHEEL LIFT SYNCHRONIZATION, which claims priority to provisional patent applications U.S. Ser. No. 61/942,433 filed on Feb. 20, 2014, entitled "PNEUMATIC WHEEL LIFT SYNCHRONIZATION," and U.S. Ser. No. 61/970,720 filed on Mar. 26, 2014, entitled "PNEUMATIC WHEEL LIFT SYNCHRONIZATION," the entire disclosures of which are herein incorporated by reference.

FIELD OF THE INVENTION

The present invention relates generally to vehicle lifts. More particularly, certain embodiments of the present invention relate to pneumatically powered vehicle lifts that employ a pulse width modulated control system for precisely synchronizing pneumatic lifts and avoiding static friction.

BACKGROUND

The maintenance of vehicles such as cars and trucks frequently requires access to the underside of the vehicles in order to permit repair of such parts as transmissions, clutches, gearing, joints, brakes, and the like. In order to reach these areas of a vehicle, a worker will typically employ one or more lifting devices that are positioned beneath the vehicle chassis or wheels and actuated to lift the vehicle above the ground.

Conventional lifting systems comprising a plurality of lifting devices may be powered by hydraulic or mechanical systems, which allow for a smooth raising and lowering motion throughout the range of travel as a result of small differences in static and dynamic friction within the system. Generally, the amount of force required to overcome static friction while a lift is at rest, is nearly the same as the force required to overcome the dynamic friction while the lift is in motion. However, single-acting gravity return cylinders in pneumatic lift systems have suffered from a great disparity in the forces required to overcome static and dynamic friction, as compared to their hydraulic and mechanical counterparts. The compressible nature of air results in the inability to obtain small and precise adjustments in order to maintain the smooth synchronization of lifts, resulting in more of a "ratcheting" motion of the lifts.

U.S. Pat. No. 5,484,134, which is herein incorporated by reference in its entirety, discloses pneumatic lifts for holding a vehicle in a lifted position while being worked on. U.S. Patent Application Publication No. 2013/0240812, which is herein incorporated by reference in its entirety, discloses a pneumatic lift system capable of performing an electronically synchronized lift using two or more individual lifts. The wheel lift system of the '812 application is pneumatically powered via an external source of compressed air, and the system is electronically controlled from a common control station/module. Although the lift system of the '812 application represents a significant advancement in automobile wheel lifts, the system of said application does not solve the problem of smoothly overcoming static and dynamic friction in pneumatic lift systems.

SUMMARY

One embodiment of the present invention broadly includes a self-synchronizing wheel lift system configured to lift a vehicle using compressed air. The lift system comprises a plurality of pneumatic wheel lifts and a lift control system. The lift control system is configured to automatically synchronize the heights of the wheel lifts during vehicle lifting without causing any of the wheel lifts to completely stop during vehicle lifting.

Another embodiment of the present invention broadly includes a vehicle lifting method. The method includes an initial step of lifting at least one end of a vehicle using a plurality of pneumatically powered wheel lifts, each comprising a pneumatic cylinder. During the lifting step, the method includes synchronizing the heights of the wheel lifts using a lift control system, with the lift control system being configured to automatically synchronize the heights of the wheel lifts during the lifting without causing any of the wheel lifts to completely stop its lifting.

An additional embodiment of the present invention includes a non-transitory computer readable storage medium with an executable program stored thereon for adjusting control signals in a pneumatic lift system. The computer program instructs a processor to perform the steps of the method. The method includes the initial step of receiving vertical position information for two or more pneumatic lifts in the lift system. An additional step includes comparing the vertical position information of the two or more pneumatic lifts to determine a first lift that has a highest vertical position and a second lift that has a lower vertical position than the first lift. A next step includes determining a duty cycle of a control signal for controlling air flow relative to the second lift, the duty cycle having an on portion and an off portion. A next step includes adjusting the duty cycle of the control signal for the second lift by reducing the on portion and increasing the off portion, such that the rate at which the second lift is being lowered is reduced. The rate at which the second lift is being lowered during the adjust step is always greater than zero.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figures 13A, 13B, 13C, 13D:
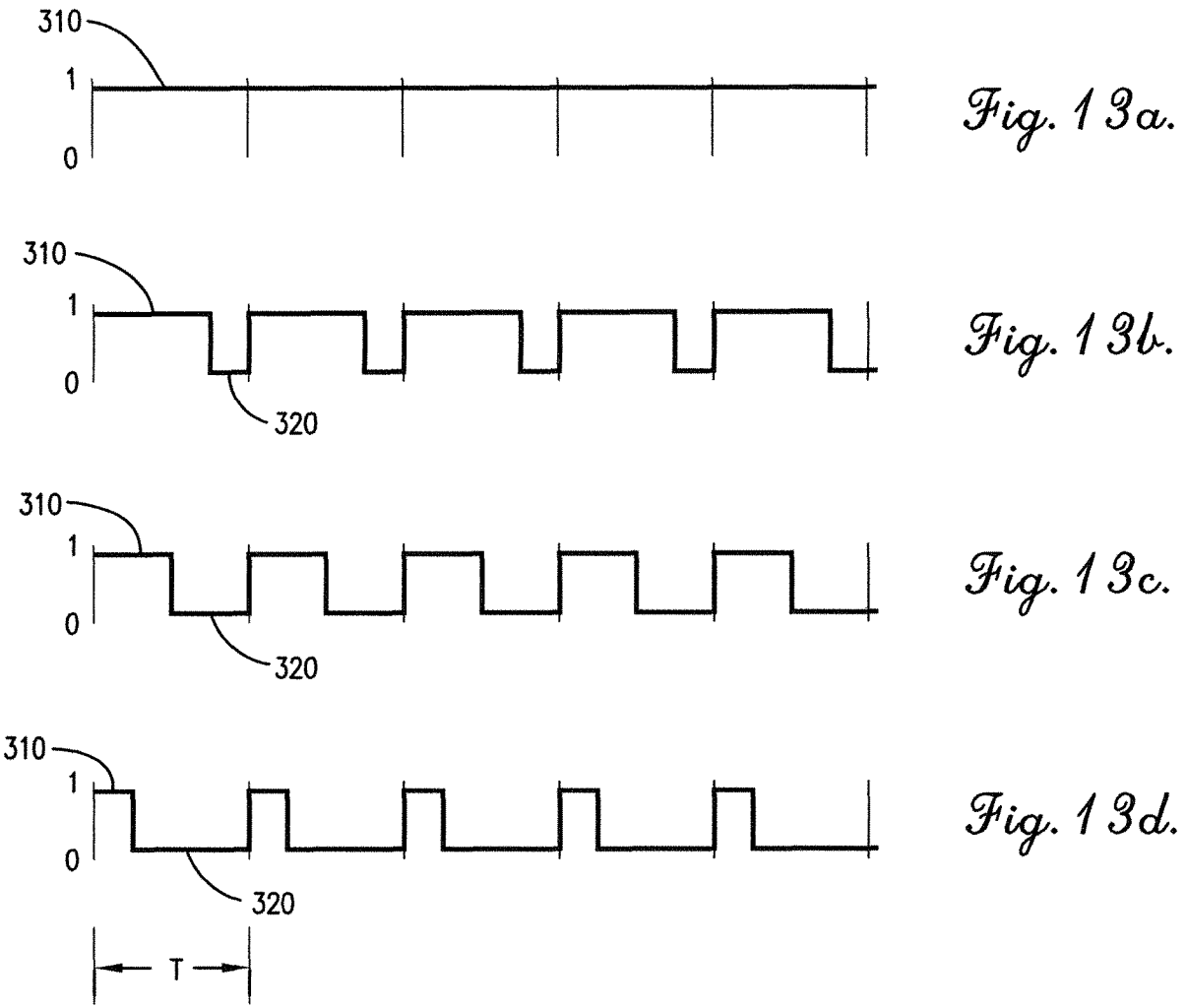
Figure 14:
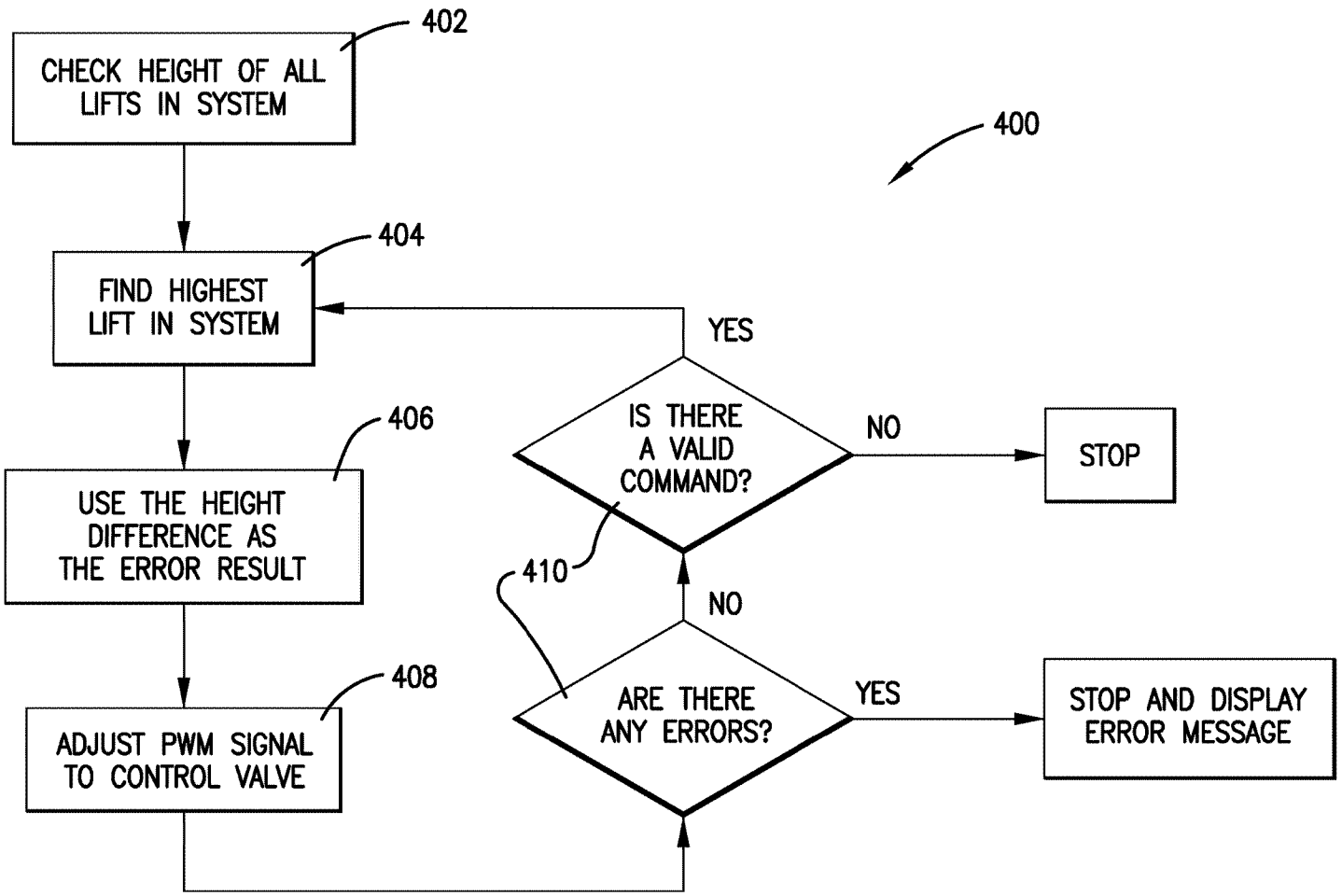
Figure 15:
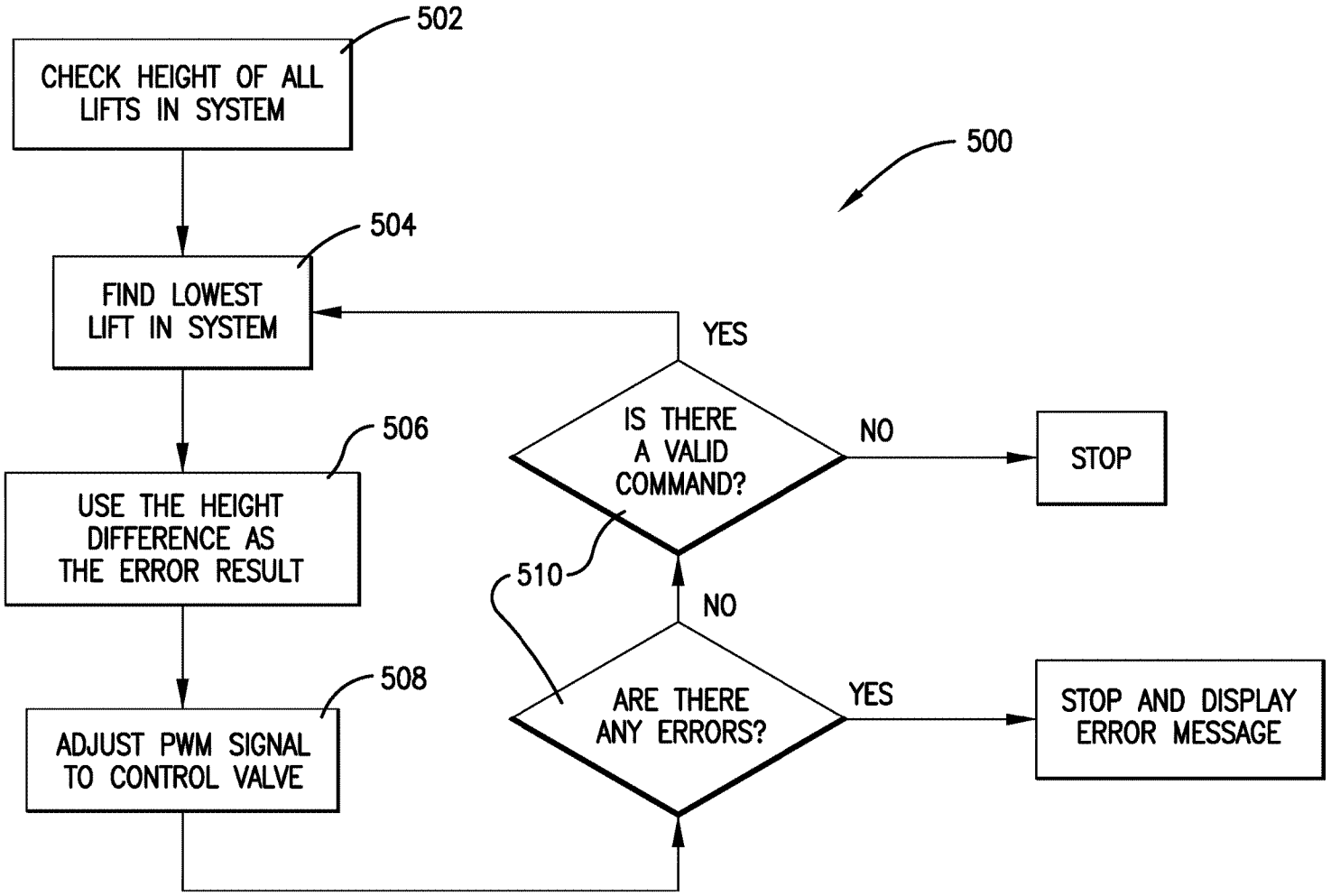

FIG. 13*a* is a graphic illustration of a valve control signal having a duty cycle of one-hundred percent;

FIG. 13*b* is a graphic illustration of a valve control signal having a duty cycle of seventy-five percent;

FIG. 13*c* is a graphic illustration of a valve control signal having a duty cycle of fifty percent;

FIG. 13*d* is a graphic illustration of a valve control signal having a duty cycle of twenty-five percent;

FIG. 14 is a flowchart of a method for performing a synchronized lowering of lifts in a lift system according to embodiments of the present invention; and FIG. 15 is a flowchart of a method for performing a synchronized raising of lifts in a lift system according to embodiments of the present invention.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Figure 1:
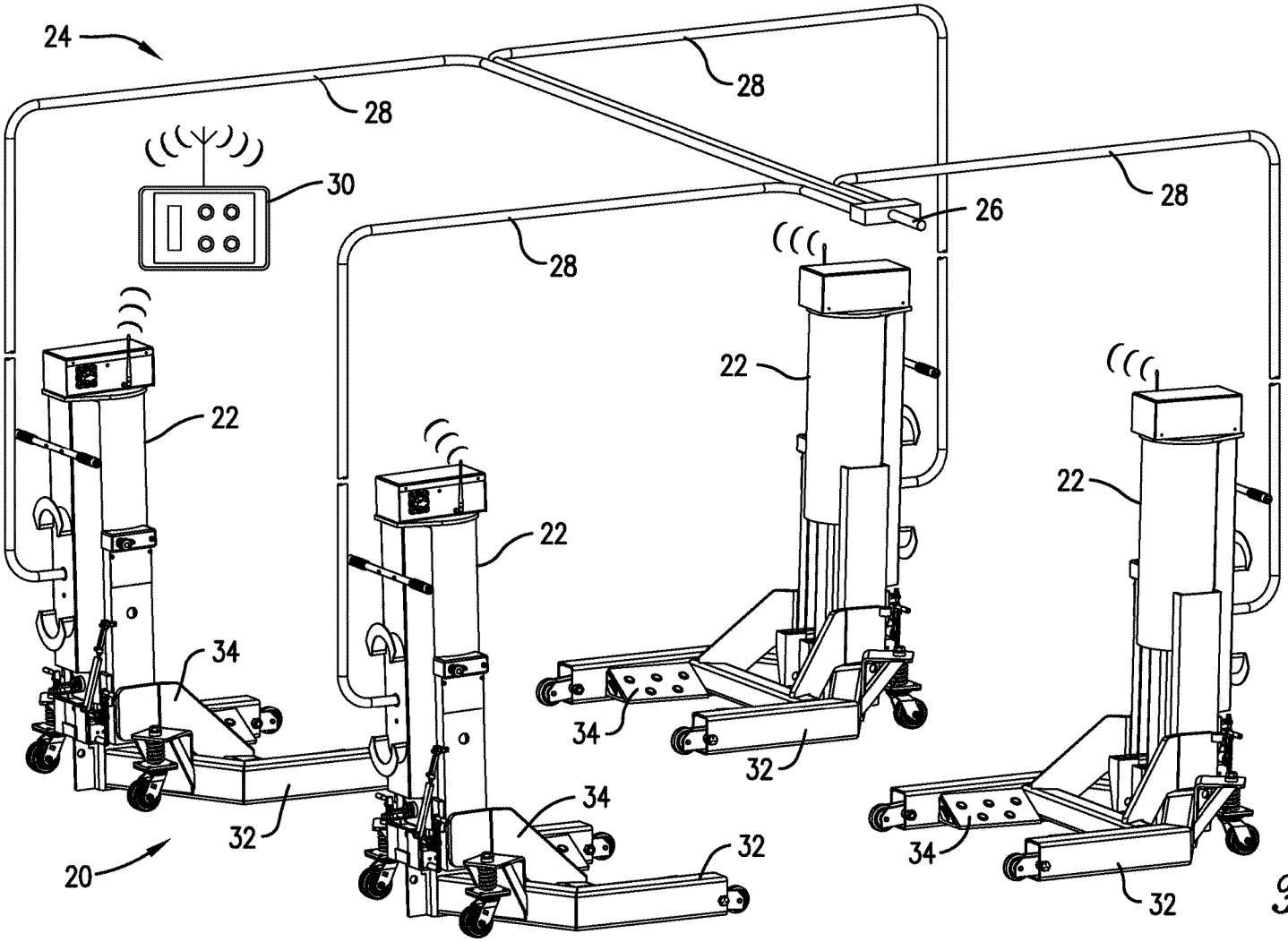
FIG. 1 illustrates a pneumatic lift system having four individual pneumatic lifts that receive compressed air form an overhead air distribution system and are controlled via a wireless handheld control module.

FIG. 1 illustrates a wheel-engaging pneumatic lift system 20 having four individual pneumatic lifts 22 that receive compressed air from an overhead air distribution system 24. Compressed air from an external source can be supplied to the overhead air distribution system 24 via a supply line 26. The air in the supply line 26 can be split among distribution lines 28, which each supply compressed air to a respective one of the pneumatic lifts 22. Although FIG. 1 depicts two pair of pneumatic lifts 22, it should be noted that a single pair of pneumatic lifts 22 can be used to lift one end of a vehicle, while the other end remains on the ground. Further, for vehicles with more than four wheels, the pneumatic lift system 20 can include three or more pairs of pneumatic lifts 22 to match the total number of axles on the vehicle.

The pneumatic lift system 20 includes a lift system control system (LS control system) for controlling all or part of the functions of the individual pneumatic lifts 22. In some embodiments, the LS control system will comprise a wireless handheld control module 30 for controlling the individual lifts 22. For example, the wireless handheld control module 30 can control raising, parking, and/or lowering of all of the pneumatic lifts 22 of the lift system 20. In addition, the LS control system may include, for each of the pneumatic lifts 22 of the lift system 20, an electrical control system, a pneumatic control system, and a position sensor, as will be discussed in more detail below.

In more detail, the wireless handheld control module 30 can include a processing element, such as a processor, a circuit board (e.g., FPGA), and/or a programmable logic controller (PLC), for processing information relating to the lifting and/or lowering operations of the lifts 22 of the lift system 20. The control module 30 can also include one or more rechargeable batteries. The control module 30 can be configured to accept user input through the use of contact switches, a touch screen display, and/or voice actuation. The control module 30 can include a display for providing information about the pneumatic lifts 22 to the operator of the lift system 20. The display can be, for example, a liquid crystal display (LCD) or a touch screen display that displays various instructions and/or prompts for the operator of the pneumatic lift system 20 to follow during setup and operation. The control module 30 can be configured for two-way wireless communication (e.g., via a radio frequency transceiver) with each of the pneumatic lifts 22.

As shown in FIG. 1, each pneumatic lift 22 can include a base assembly 32 and a cradle assembly 34 that is vertically shiftable relative to the base assembly 32. The base assembly 32 is configured to support the pneumatic lift 22 on the ground. The cradle assembly 34 is configured to engage the tires of a vehicle to be lifted by the pneumatic lift 22. Each lift 22 can include a pneumatic lifting system having a pneumatically-powered main cylinder (not shown in FIG. 1) for selectively raising the cradle assembly 34 relative to the base assembly 32, so that the wheels of the vehicle supported on the cradle assemblies 34 of the pneumatic lift system 20 are lifted off the ground. Each of the cradle assemblies 34 can include wheel engaging surfaces presenting a plurality of protrusions capable of gripping the tires of the vehicle being lifted.

The electrical control system of each of the pneumatic lifts 22 may include a processing element, such as a processor, a circuit board (e.g., FPGA), and/or a programmable logic controller (PLC), for processing information relating to the lifting and/or lowering operations of its associated pneumatic lift 22. In particular, the electrical control system may control or otherwise provide instruction to the pneumatic control system of its associated lift 22. The electrical control system of each pneumatic lift 22 will be described in more detail below.

The pneumatic control system of the pneumatic lifts may include one or more valves and solenoids for controlling an amount of air being injected into or removed from the main cylinder of its associated lift 22 for raising and lowering, respectively, the pneumatic lift 22. The pneumatic control system of each pneumatic lift 22 will be described in more detail below.

Each of the pneumatic lifts 22 can be equipped with one or more position sensors, which are configured to provide an indication of the absolute and/or relative vertical position of the cradle assemblies 34 of the lifts 22. The position sensor may comprise a position detection device such as, for example, an electronic limit switch system, an electronic height sensor, and/or an electronic level. Examples of suitable electronic height sensors include distance sensing laser emitting devices and string potentiometers. In certain embodiments, the position sensor may be directly coupled to the pneumatic lift 22. In other embodiments, the position sensor may not be directly coupled to the pneumatic lift 22, but can be attached to the vehicle being lifted by the lift system 20. When an electronic level is used, such a level can include an accelerometer and can be configured for attachment to the vehicle being lifted by the lift system 20

In some embodiments, the electrical control system of each pneumatic lift 22 can also include a wireless communication device configured to wirelessly transmit wireless information and data to the wireless handheld control module 30. Such information received by the wireless handheld control module 30 can include vertical position information provided by the position sensors of each pneumatic lift 22 in the lift system 20. This allows the absolute or relative vertical position of each pneumatic lift 22 to be tracked and controlled in real time.

In certain embodiments, the processing element associated with the wireless handheld control module 30 can be programmed to receive and store (e.g., via one or more memory elements) vertical position information about each the pneumatic lifts 22 and then automatically control the individual pneumatic lifts 22 in a manner such that the base assembly 32 of each of the pneumatic lifts 22 are maintained at substantially similar heights during raising and/or lowering of a vehicle. Such coordinated/synchronized lifting enables pneumatic lifts 22 to perform a full vehicle lift (e.g., both front and back portions of the vehicle); in contrast to prior pneumatic lift systems, which could only safely lift one end of a vehicle at a time.

Figure 2:
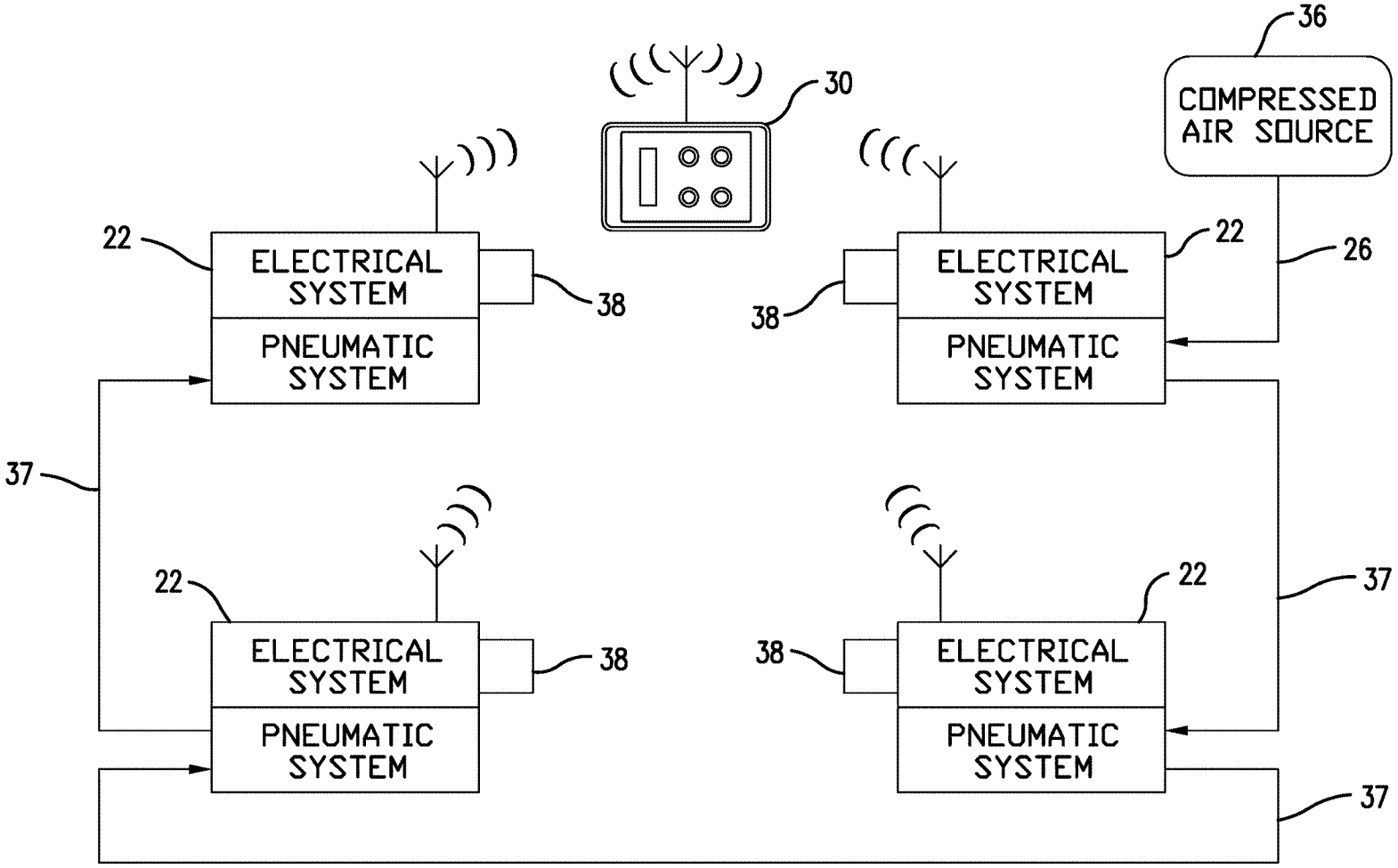
FIG. 2 is a simplified schematic depiction of a pneumatic lift system having four individual pneumatic lifts that receive compressed air via serially connected distribution lines, particularly illustrating that each lift has an electrical control system, a pneumatic control system, and a position sensor.

FIG. 2 provides a simplified schematic representation of an alternatively configured pneumatic lift system 20, where a compressed air source 36 provides compressed air via a supply line 26 to a first one of the pneumatic lifts 22. The compressed air supplied to the first one of the pneumatic lifts 22 can then be distributed to the other pneumatic lifts 22 via a plurality of serially-connected distribution lines 37. FIG. 2 also shows that each pneumatic lift 22 includes its own electrical control system and pneumatic control system that interact with one another to allow for coordinated/synchronized control of all the pneumatic lifts 22 via the wireless handheld control module 30. As illustrated in FIG. 2, each of the pneumatic lifts 22 may include position sensor 38 for providing an indication of the height of the individual pneumatic lift 22 with which the position sensor 38 is associated.

Figure 3:
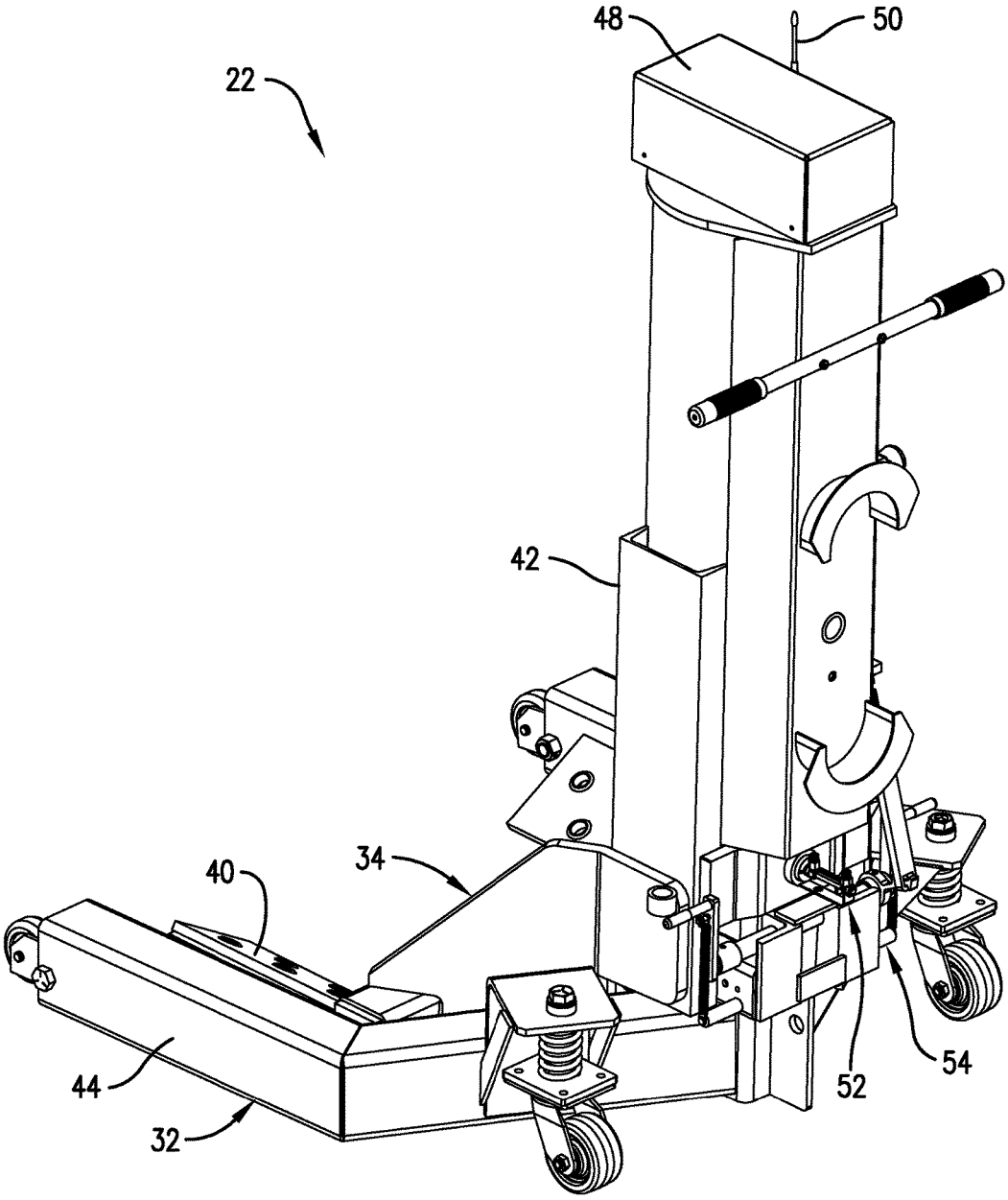
FIG. 3 is an isometric view of one of the pneumatic lifts of the system depicted in FIG. 1, where the lift includes a base assembly, a cradle assembly shiftable relative to the base assembly, a mechanical downstop system, and a mechanical height locking system.
Figure 4:
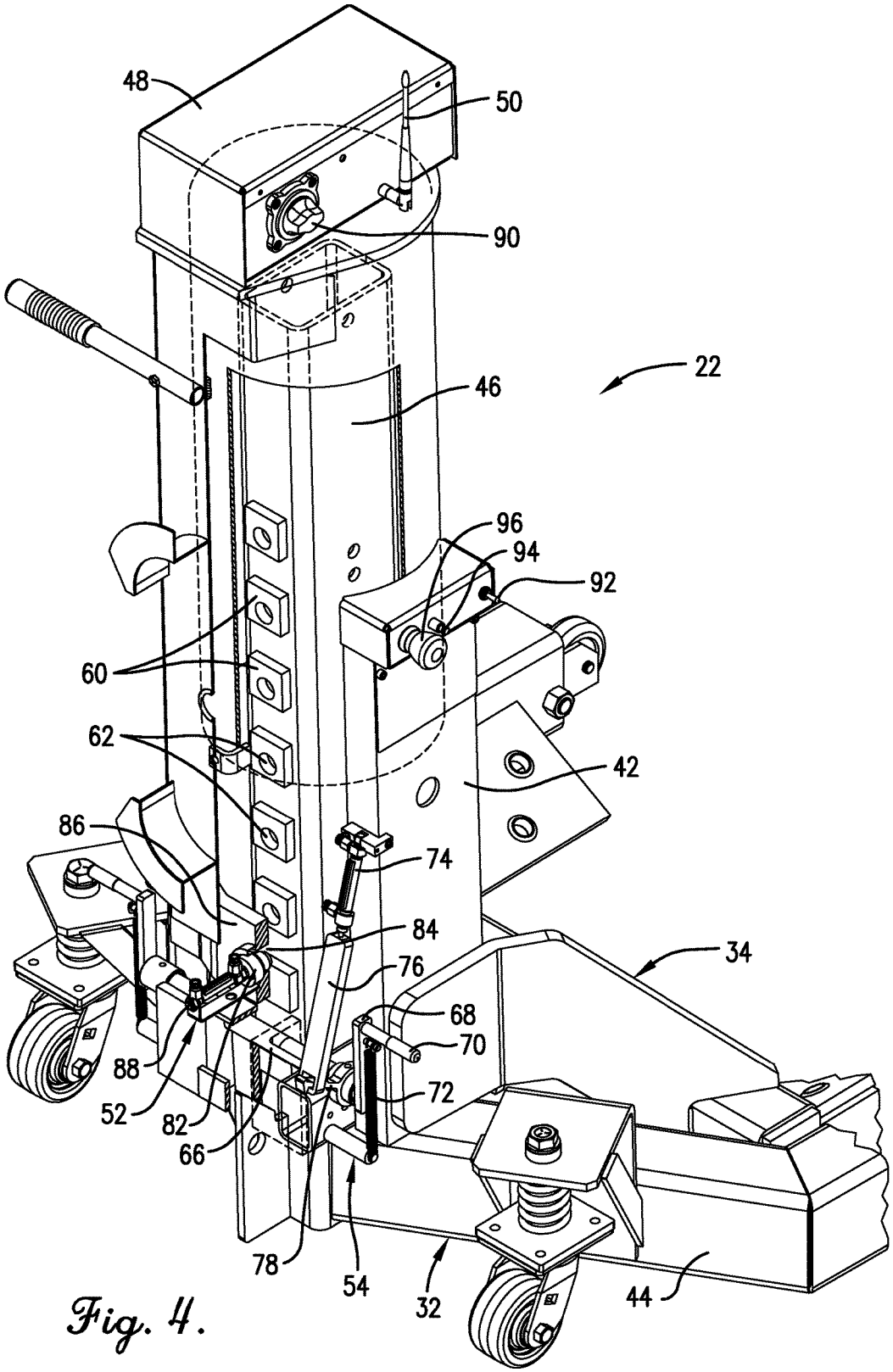
FIG. 4 is an isometric view of the lift of FIG. 3, with certain portions of the lift being cut away to better view the lift's downstop and height locking systems.

FIGS. 3-7 provide enlarged views of a single pneumatic lift 22 suitable for use in the pneumatic lift system 20 depicted in FIGS. 1 and 2. FIGS. 3 and 4 show that the cradle assembly 34 of the pneumatic lift 22 can include a lower wheel-engaging section 40 and an upper post-receiving section 42, while the base assembly 32 of the pneumatic lift 22 can include a ground engaging support 44 and an upright post 46 (FIG. 4). As shown in FIG. 3, the pneumatic lift 22 can include an electronics enclosure 48 coupled to the upper section 42 of the cradle assembly and configured to house at least a portion of the electrical control system of the pneumatic lift 22. The portion of the electrical control system housed in the enclosure 48 can include, for example, a rechargeable battery, a wireless transceiver, and/or the processing element. An antenna 50 can be attached to the pneumatic lift 22 to facilitate two-way wireless communication with other pneumatic lifts 22 of the system and/or with a wireless handheld control module 30, as discussed above.

Referring again to FIG. 3, the pneumatic lift 22 can include an automatic height locking system 52 for selectively preventing vertical movement of the cradle assembly 34 relative to the base assembly 32. When engaged in a locked/parked configuration, the height locking system 52 allows the pneumatic lift 22 to function like a stand, to support a raised vehicle so it can be safely worked on. The pneumatic lift 22 can also include an automatic downstop system 54 for selectively inhibiting unrestricted downward movement of the cradle assembly 34 relative to the base assembly 32. In one embodiment, the downstop system 54 comprises a pawl and ratchet assembly. In certain embodiments of the present invention, one or both of the height locking system 52 and the downstop system 54 can be wirelessly controlled by a common control unit/module, such as the wireless handheld control module 30 discussed above with reference to FIGS. 1 and 2.

Figure 5:
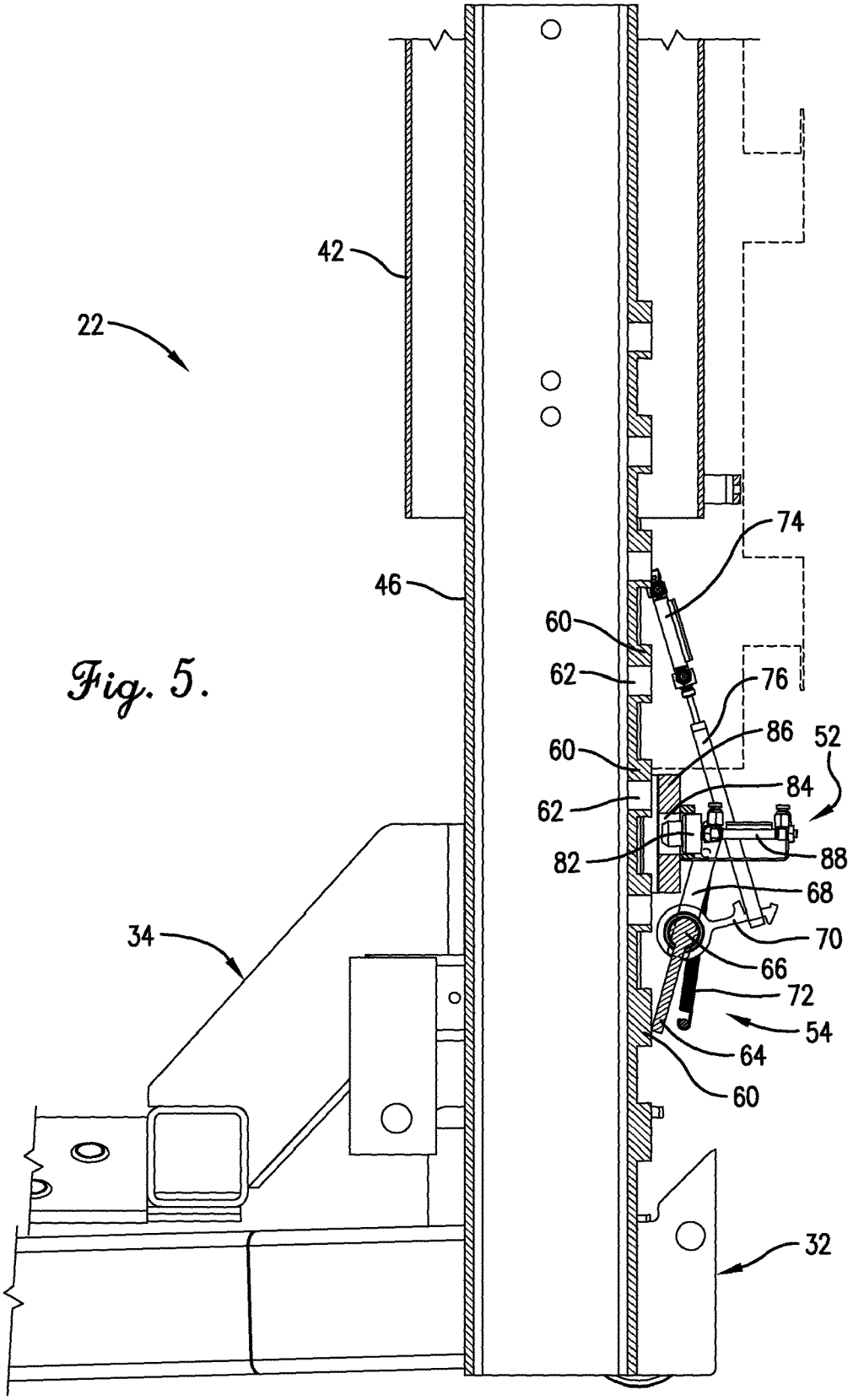
FIG. 5 is a partial side sectional view of the lift of FIG. 3, particularly illustrating the lift in a raising configuration.

Referring now to FIGS. 4 and 5, the individual components of the pneumatic lift 22 will now be described in greater detail. The upright post 46 of the base assembly 32 can include a plurality of vertically-spaced downstop lugs 60 and a plurality of vertically-spaced locking holes 62. The downstop system 54 includes a downstop pawl 64 coupled to the upper post-receiving section 42 of the cradle assembly 34 and configured to engage the downstop lugs 60 and the side of the upright post 46 as the cradle assembly 34 moves upward relative to the upright post 46.

The downstop pawl 64 is fixed to a pivoting pawl support member 66. Both the downstop pawl 64 and the pawl support member 66 can be pivoted relative to the cradle assembly 34 on a substantially horizontal pivot axis. The downstop system 54 also includes a manual pivot arm 68 coupled to the pivoting pawl support member 66. A downstop handle 70 is coupled to the manual pivot arm 68 at a location spaced from where the pivoting pawl support member 66 is connected to the manual pivot arm 68. The downstop handle 70 allows the downstop pawl 64 to be manually shifted into and out of engagement with the downstop lug 60. A downstop spring 72 is also coupled to the manual pivot arm 68 at a location spaced from where the pivoting pawl support member 66 is connected to the manual pivot arm 68. The downstop spring 72 biases the terminal end of the downstop pawl 64 into engagement with the upright post 46 and the downstop lugs 60, thereby maintaining engagement of the downstop pawl 64 with the upright post 46 and the downstop lugs 60 when the cradle assembly 34 is raised relative to the base assembly 32.

The downstop system 54 also includes a downstop actuator 74 and an actuator linkage 76 for connecting the downstop actuator 74 to an automatic pivot arm 78. The automatic pivot arm 78 is coupled to the pivoting pawl support member 66 so that translational movement of the automatic pivot arm 78 causes rotational movement of the pivoting pawl support member 66, thereby shifting the downstop pawl 64. The downstop actuator 74 can be a pneumatic actuator powered by compressed air from the same source as the compressed air used to raise the cradle assembly 34 relative to the base assembly 32. In the embodiment depicted in FIGS. 4 and 5, the downstop actuator 74 is a two-way pneumatic cylinder that, when actuated, shifts the terminal end of the downstop pawl 64 either toward or away from the upright post 46. As discussed in further detail below, the downstop actuator 74 can be electronically controlled via any suitable means such as, for example, a solenoid in communication with the electrical control system. The downstop actuator 74 can include a position sensor that communicates the position of the downstop actuator 74 to the electrical control system so the electrical control system knows whether the downstop system 54 is engaged or disengaged.

As shown in FIGS. 4 and 5, the height locking system 52 can include a locking pin 82 that is received in a locking pin opening 84 formed in a rigid support member 86 of the cradle assembly 34. The height locking system 52 can also include a locking pin actuator 88 for shifting the locking pin 82 relative to the rigid support member 86. The locking pin 82 can include a first (narrower) portion sized for close-fitting receipt in the locking hole 62 of the upright post 46. The locking pin 82 can also include a second (broader) portion sized for close-fitting receipt in the locking pin opening 84 of the rigid support member 86.

The locking pin actuator 88 is configured to shift the height locking system 52 between a parked/locked configuration and an unlocked configuration. When the height locking system 52 is in the locked configuration the first (narrower) portion of the locking pin 82 is received in one of the locking holes 62 of the upright post 46 and the second (broader) portion of the locking pin 82 is received in the locking pin opening 84 of the rigid support member 86. In this locked configuration, the locking pin 82 prevents vertical shifting of the rigid support member 86 relative to the upright post 46, thereby also preventing raising and lowering of the cradle assembly 34 relative to the base assembly 32. Thus, the locking pin actuator 88 can shift the height locking system 52 from the locked/parked configuration to the unlocked configuration by simply removing locking pin 82 from the locking hole 62 within which it was received. With the locking pin 82 removed from the locking hole 62, vertical shifting of the cradle assembly 34 relative to the base assembly 32 is not inhibited by the height locking system 52.

The locking pin actuator 88 can have a substantially similar configuration as the downstop actuator 74, described above. Thus, the locking pin actuator 88 can be a pneumatic actuator powered by compressed air from the same source as the compressed air used to raise the cradle assembly 34 relative to the base assembly 32. In one embodiment, the locking pin actuator 88 is a two-way pneumatic cylinder that can be electronically controlled via a solenoid that communicates with the pneumatic lift's 22 electrical control system. The locking pin actuator 88 can include a position sensor that communicates the position of the locking pin 82 to the electrical control system of the pneumatic lift 22 so the electrical control system knows whether the height locking system 52 is the locked/parked configuration or the unlocked configuration.

In certain embodiments of the present invention, the locking pin actuator 88 and/or the downstop actuator 74 may be activated using the wireless handheld control module 30 described above with reference to FIGS. 1 and 2. The wireless handheld control module 30 may have dedicated input devices for directly activating the locking pin actuator 88 and/or the downstop actuator 74. Alternatively, the locking pin actuator 88 and/or the downstop actuator 74 may be indirectly activated from wireless handheld control module 30 by utilizing a program that automatically activates the locking pin actuator 88 and/or the downstop actuator 74 when certain commands are provided via the control module 30. For example, the components of the lift system 20 may be configured such that a "lower" command inputted at the wireless handheld control module 30 may (1) automatically activate the locking pin actuator 88 to shift the locking pin 81 into the unlocked position and (2) automatically activate the downstop actuator 74 to shift the downstop pawl 64 into the disengaged position.

Figure 6:
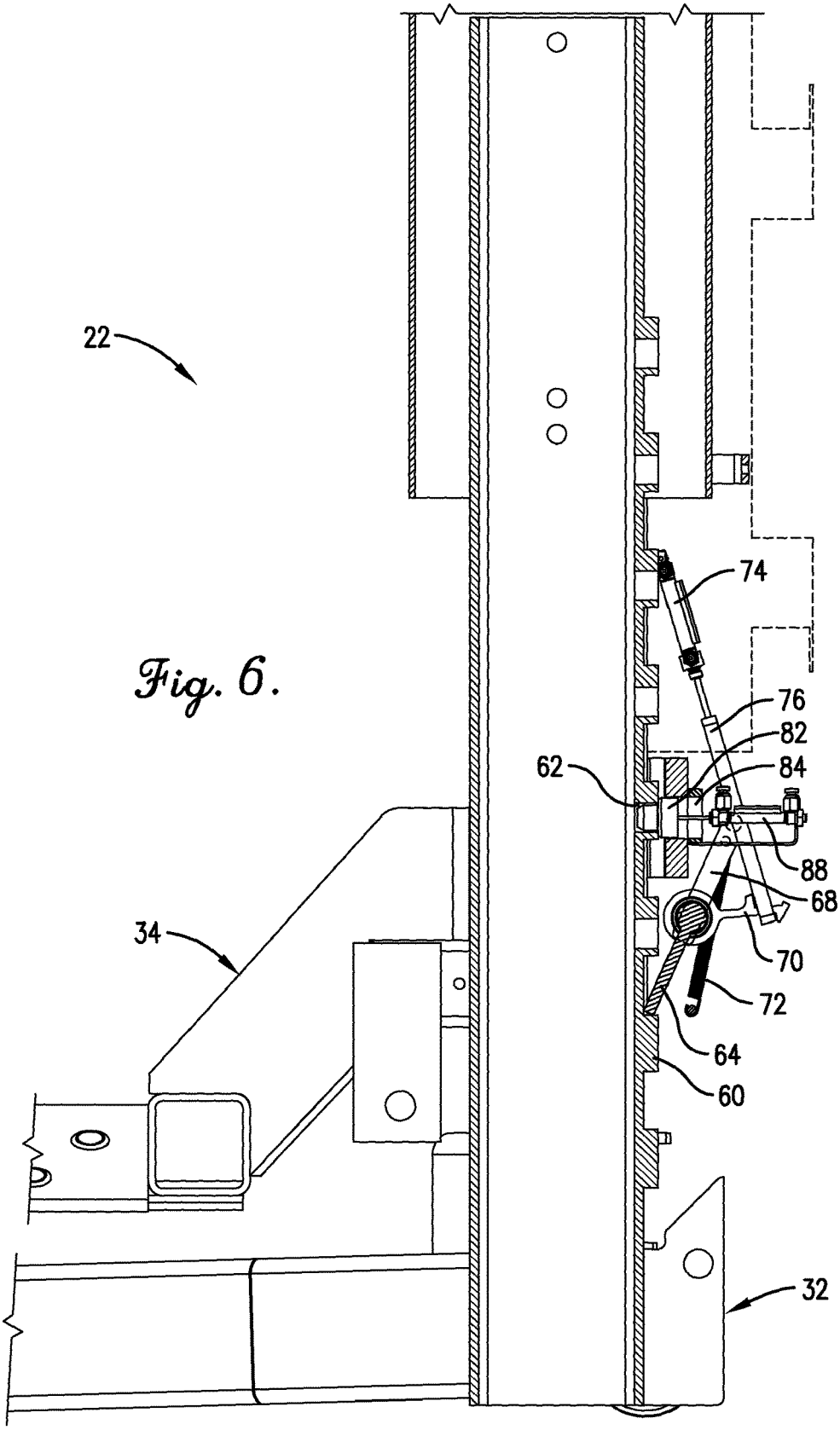
FIG. 6 is a partial side sectional view of the lift of FIG. 3, particularly illustrating the lift in a locked configuration.
Figure 7:
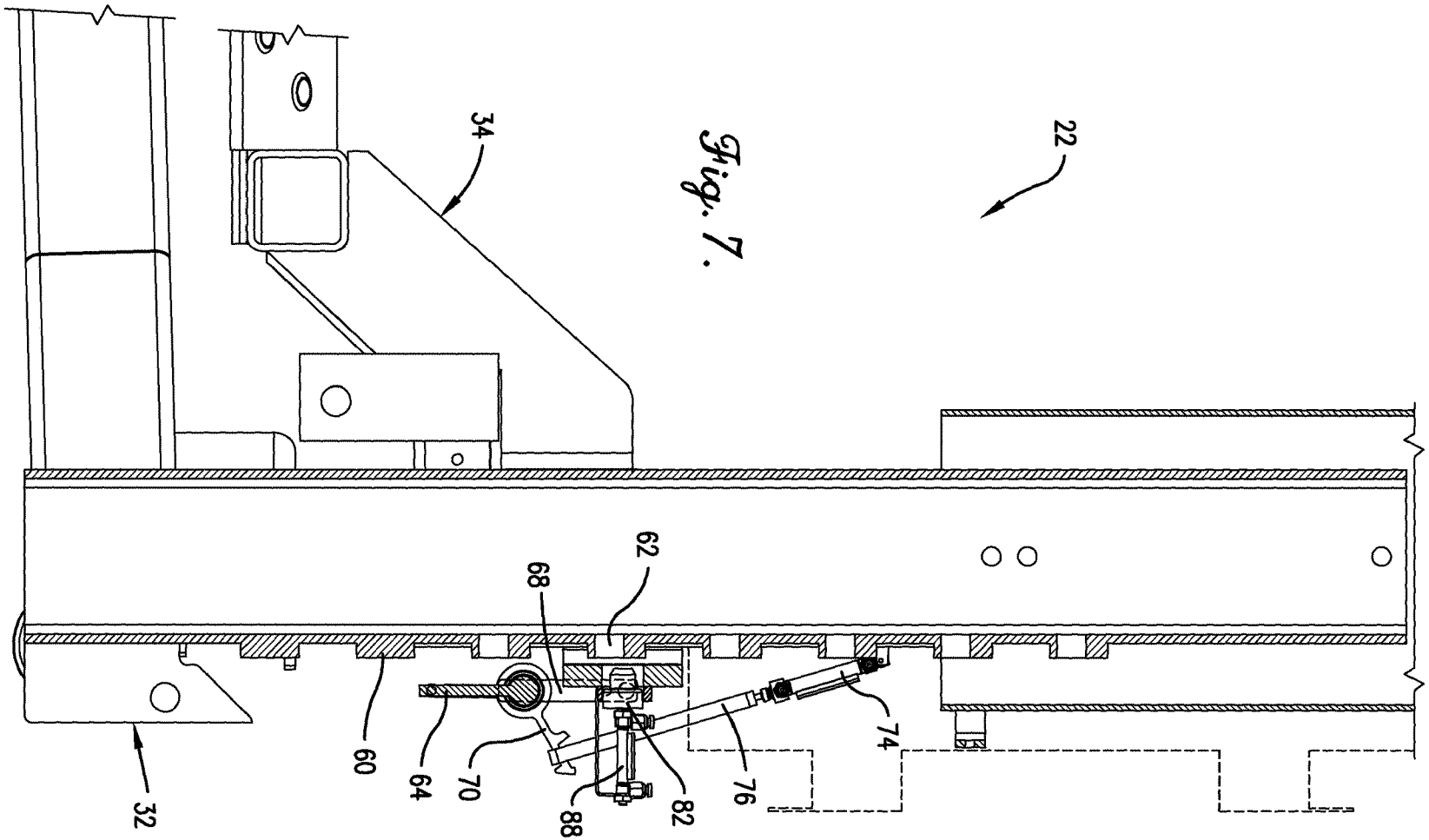
FIG. 7 is a partial side sectional view of the lift of FIG. 3, particularly illustrating the lift in a lowering configuration.

FIGS. 5-7 illustrate the height locking system 52 and the downstop system 54 in various positions/configurations that are experienced during normal operation of the pneumatic lift 22 to raise, park, and lower a vehicle. FIG. 5 depicts the lift 22 in a raising configuration. During raising of the cradle assembly 34 relative to the base assembly 32, the height locking system 52 is in the unlocked configuration, with the locking pin 82 being removed from the locking holes 62 of the upright post 46. Also, during raising of the cradle assembly 34 relative to the base assembly 32, the downstop system 54 is in an engaged configuration, where the downstop spring 72 holds the downstop pawl 64 into engagement with the side of the upright post 46 and the downstop lugs 60. As the cradle assembly 34 rises relative to the upright post 46 of the base assembly 32, the terminal end of the downstop pawl 64 travels up the side of the upright post 46, passing over each of the downstop lugs 60 along the way. When the cradle assembly 34 reaches the desired height, the electrical control system of the pneumatic lift 22 automatically lowers the cradle assembly 34 until the terminal end of the downstop pawl 64 engages the upper surface of the next lower downstop lug 60. Once the terminal end of the downstop pawl 64 is resting on the upper surface of one of the downstop lugs 60, the cradle assembly 34 can no longer shift downwardly relative to the upright post 46. Additionally, once the terminal end of the downstop pawl 64 is resting on the upper surface of one of the downstop lugs 60, the locking pin 82 is aligned for insertion into one of the locking holes 62 on the upright post 46. At this point, the height locking system 52 can be shifted into the parked/locked configuration by the locking pin actuator 88.

FIG. 6 depicts the pneumatic lift 22 in a parked/locked configuration, with the locking pin 82 being inserted into one of the locking holes 62 on the upright post 46. In the parked/locked configuration, the terminal end of the downstop pawl 64 is also held in engagement with the top surface of one of the downstop lugs 60. Thus, when the pneumatic lift 22 is in the locked configuration, downward movement of the cradle assembly 34 relative to the base assembly 32 is prevented by two mechanical lock mechanisms, the height locking system 52 and the downstop system 54.

FIG. 7 depicts the pneumatic lift 22 in a lowering configuration, with the height locking system 52 being unlocked and the downstop system 54 being disengaged. In order to shift the lift from the locked configuration shown in FIG. 6 to the lowering configuration shown in FIG. 7, the following steps are carried out: (1) the locking pin actuator 88 shifts the height locking system 52 from the locked configuration to the unlocked configuration by removing the locking pin 82 from the locking hole 62; (2) main cylinder of the pneumatic lift 22 slightly raises the cradle assembly 34 relative to the upright post 46 until the terminal end of the downstop pawl 64 is vertically spaced from the top surface of the downstop lug 60 upon which it was resting; (3) the downstop actuator 74 shifts the downstop system 54 from the engaged configuration to the disengaged configuration where the terminal end of the downstop pawl 64 is spaced from the upright post 46 and the downstop lugs 60. Once the pneumatic lift 22 is in the lowering configuration, the cradle assembly 34 can be lowered relative to the base assembly 32. After the cradle assembly 34 has been lowered to the desired level, the pneumatic lift 22 can be shifted back in the raising configuration, shown in FIG. 5, by simply using the downstop actuator 74 to shift the downstop pawl 64 back into the engaged configuration.

Referring back to FIG. 4, the pneumatic lift 22 can be equipped with manual controls for turning on, raising, lowering, and stopping the pneumatic lift 22. For example, the pneumatic lift 22 can include a manual main power switch 90, a manual raise/lower switch 92, a manual hold-to-run switch 94, and a manual emergency stop (E-stop) switch 96. The pneumatic lift 22 can be manually turned on by activating the main power switch 90. The pneumatic lift 22 can be manually raised by pressing and holding the hold-to-run switch 94 and simultaneously shifting the raise/lower switch 92 to the raise position. The pneumatic lift 22 can be lowered by pressing and holding the hold-to-run switch 94 and simultaneously shifting the raise/lower switch 92 to the lower position. This manual raising and lowering of the pneumatic lift 22 can be performed independently of any common electrical control unit/module of the lift system 20, such as the wireless handheld control module 30.

Referring again to FIG. 4, in the case of an emergency situation, the pneumatic lift 22 can be stopped by manually activating the E-stop switch 96. When the E-stop switch 96 is actuated, the electronic system of the pneumatic lift 22 sends out a signal that stops all other lifts in the system. Such an E-stop signal can be transmitted wirelessly by the activated lift and received direct by all other lifts. Alternatively, the E-stop signal can be transmitted wirelessly to the wireless handheld control module 30 that then wirelessly communicates a universal stop signal to all the lifts in the system.

Figure 8:
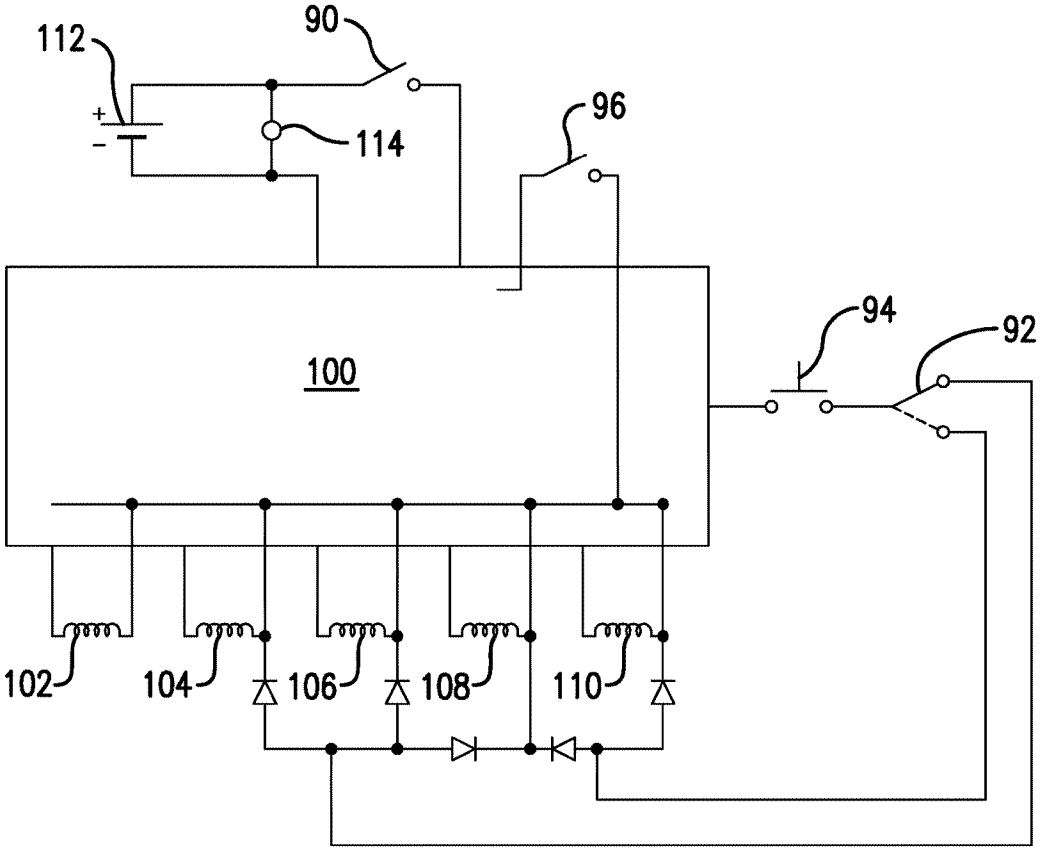
FIG. 8 is a schematic electrical diagram of a portion of a lift's electrical control system that controls the lift's pneumatic cylinders.
Figure 9:
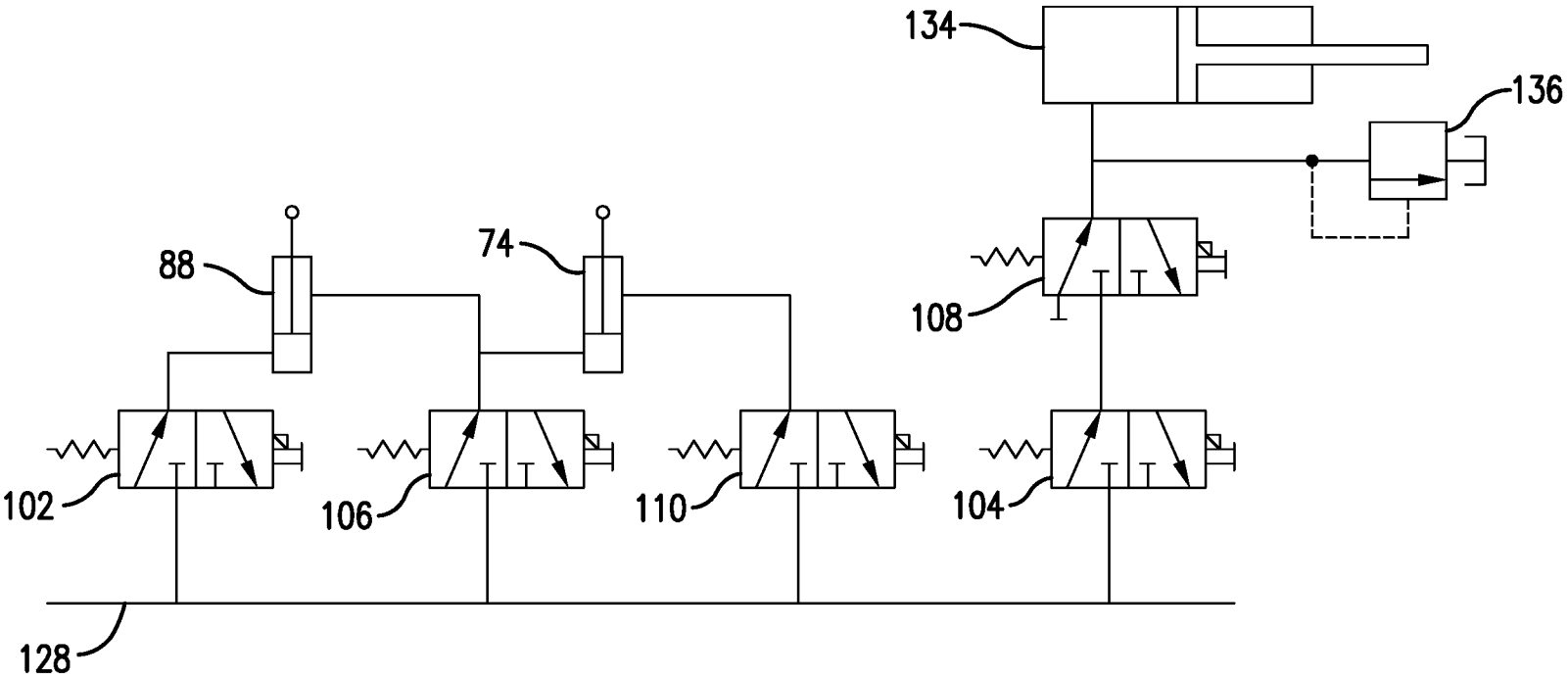
FIG. 9 is a schematic pneumatic diagram showing how the lift's pneumatic cylinders provide for control of various function of the lift.

FIGS. 8 and 9 provide schematic electrical control system (FIG. 8) and pneumatic control system (FIG. 9) diagrams illustrating how the electrical control system of each lift 22 interacts with the pneumatic control system of each lift 22. The interaction between the electrical control system and the pneumatic control system allows the various functions of each pneumatic lift in the system to be electronically controlled from a common control unit/module, such as the wireless handheld control module 30.

FIG. 8 is a partial depiction of the electrical control system of a pneumatic lift 22 configured in accordance with certain embodiments of the present invention. FIG. 8 does not specifically illustrate a position sensor and/or a wireless communication device, which each may be associated with the electrical control system. However, it should be noted that such components can also be part each lift 22 and in association and/or communication with the electrical control system. As shown in FIG. 8, the portion of the electrical control system that controls the pneumatic system of the lift 22 can include a processing element 100, which may comprise, as stated above, a processor, a circuit board (e.g., FPGA), and/or a programmable logic controller (PLC), or the like. The processing element 100 may communicate with one or more of the following components of the pneumatic control system: a locking pin engage valve 102, a raise valve 104, a downstop engage valve 106, a lower valve 108, and a downstop disengage valve 110. Each of these pneumatic valves may include a solenoid that, when energized by the processing element 100, shifts the pneumatic valve into a different configuration. This allows the pneumatic valves to be electronically controlled via the electrical control system of the lift 22, or from a common control unit/module that communicates with the processing element 100, such as the handheld mobile control unit 30. FIG. 8 also shows other components that may be in communication with and/or associated with the electrical control system, such as a rechargeable battery 112, a charger jack 114, the main power switch 90, the manual raise/off/lower toggle switch 92, the manual hold-to-run switch 94, and/or the E-stop switch 96.

FIG. 9 shows various components of the pneumatic control system of a pneumatic lift 22 configured in accordance with certain embodiments of the present invention. The pneumatic control system comprises the pin engage valve 102, the raise valve 104, the downstop engage valve 106, the lower valve 108, and the downstop disengage valve 110. As depicted in FIG. 9, each of these valves can be a three-way pneumatic valve actuated by a corresponding solenoid. One or more of such valves may comprise proportional flow valves. The pneumatic control system can also include a compressed air supply line 128, which can be used to drive one or more of the components of the pneumatic lift 22. For instance, with the pneumatic power provided by the supply line 128, the pneumatic system can actuate the downstop actuator 74 and the locking pin actuator 88, which were previously described. In addition, the pneumatic control system may be operable to direct general movement of the lift 22 for selectively raising the cradle assembly 34 relative to the base assembly 32, via pneumatic actuation of a main lift cylinder 134 of the lift 22. In certain embodiments, the pneumatic control system may also include a pressure relief valve 136.

Interaction of the electrical and pneumatic control systems will now be described in more detail with reference to both FIGS. 8 and 9. When the processing element 100 simultaneously energizes the solenoid of the raise valve 104 and the solenoid of the lower valve 108, air is allowed into the main lift cylinder 134, thereby causing the lift 22 to rise (i.e., the cradle assembly 34 rises with respect to the base assembly 32). When the processing element 100 energizes the solenoid of the lower valve 108, air is allowed to exhaust from the main lift cylinder 134 via the raise valve 104, thereby allowing the lift 22 to lower (i.e., the cradle assembly 34 lowers with respect to the base assembly 32). In alternative embodiments, the raise valve 104 and the lower valve 108 may be independently associated with the main lift cylinder 134. In such alternative embodiments, when the processing element 100 energizes the solenoid of the raise valve 104, air is allowed into the main lift cylinder 134, thereby causing the lift to rise, and when the processing element 100 energizes the solenoid of the lower valve 108, air is allowed to exhaust from the main lift cylinder 134, thereby allowing the lift to lower.

When the processing element 100 energizes the solenoid of the downstop engage valve 106, the downstop actuator 74 extends to engage the downstop pawl 64 to the lift's 22 post 46 and the locking pin actuator 88 retracts to disengage the locking pin 82 from the locking holes 62 in the lift's 22 post 46. When the processing element 100 energizes the solenoid of the downstop disengage valve 110, the downstop actuator 74 retracts to disengage the down stop pawl 64 from the lift's 22 post 46. When the processing element 100 energizes the solenoid of the pin engage valve 102, the locking pin actuator 88 extends to insert the locking pin 82 into the locking holes 62 on the lift's 22 post 46.

When simultaneous actuation of the manual hold-to-run switch 94 and the raise side of the manual raise/off/lower toggle switch 92 occurs, the solenoids of the raise valve 104, lower valve 108, and downstop engage valve 106 are energized, thereby simultaneously causing the lift 22 to rise, the downstop pawl 64 to engage the lift's 22 post 46, and the locking pin 82 to disengage the locking holes 62 in the post 46. When simultaneous actuation of the manual hold-to-run switch 94 and the lower side of the manual raise/off/lower toggle switch 92 occurs, the solenoids of the lower valve 108 and downstop disengage valve 110 are energized, thereby simultaneously causing the down stop pawl 64 to disengage the lift's 22 post 46 and the lift 22 to lower.

Figure 10:
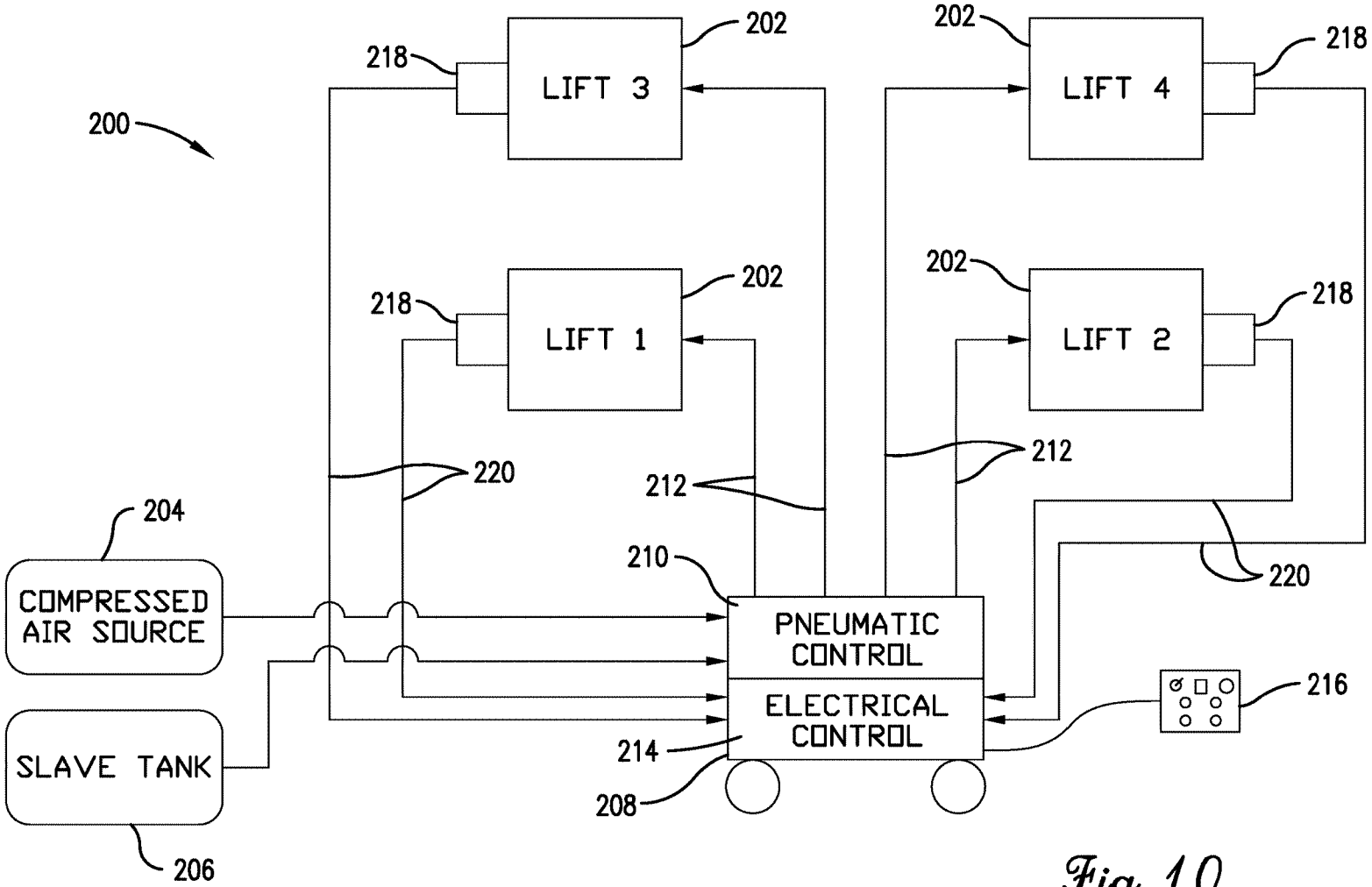
FIG. 10 is a simplified schematic depiction of an alternative pneumatic lift system utilizing a common mobile control unit to control lifts of the lift system.

FIG. 10 is a simplified depiction of a pneumatic wheel lift system 200 configured in accordance with an alternative embodiment of the present invention. The pneumatic wheel lift system 200 employs four individual wheel lifts 202. The wheel lifts 202 may be constructed substantially the same as lifts 22 previously described. As illustrated in FIG. 10, the wheel lifts 2002 may be powered by compressed air originating from a compressed air source 204 and, optionally, from a slave air tank 206. The slave air tank 206 may be employed in cases where supplemental compressed air is required. The compressed air from the air source 204 and/or slave tank 206 is first supplied to a mobile control unit 208, which includes a pneumatic control system 210. The compressed air is then supplied from the pneumatic control system 210 to each individual wheel lift 202 via pneumatic supply lines 212. The mobile control unit 208 can be a wheeled cart that includes hose reels for storage of the pneumatic supply lines 212 when the pneumatic supply lines 212 are not connected to the wheel lifts 202.

The mobile control unit 208 can also include an electrical control system 214 that interacts with and controls the pneumatic control system 210, thereby controlling the wheel lifts 202. The electrical control system 214 may be in the form of a handheld control module 216 for receiving input from an operator of the pneumatic wheel lift system 200. The handheld control module 216 can be movable relative to the mobile control unit 208. The handheld control module 216 can include a display, such as an LCD or a touch screen display. In some embodiments, a first portion of the electrical control system 214 may be in the form of the mobile control unit 208 and a second portion of the electrical control system may be associated with the handheld control module 216.

Each wheel lift 202 can be provided with a position sensor 218 for determining the absolute and/or relative heights of the wheel lifts 202. The position sensors 218 can provide the electrical control system 214 with an electronic signal indicating the height of the wheel lifts 202. This electronic signal can be provided via communication lines 220 or wirelessly. The height information provided by the position sensors 218 allows the electrical control system 214 to control the wheel lifts 202 in a manner such that the wheel lifts 202 raise and lower in a substantially synchronous, coordinated manner.

Figure 12:
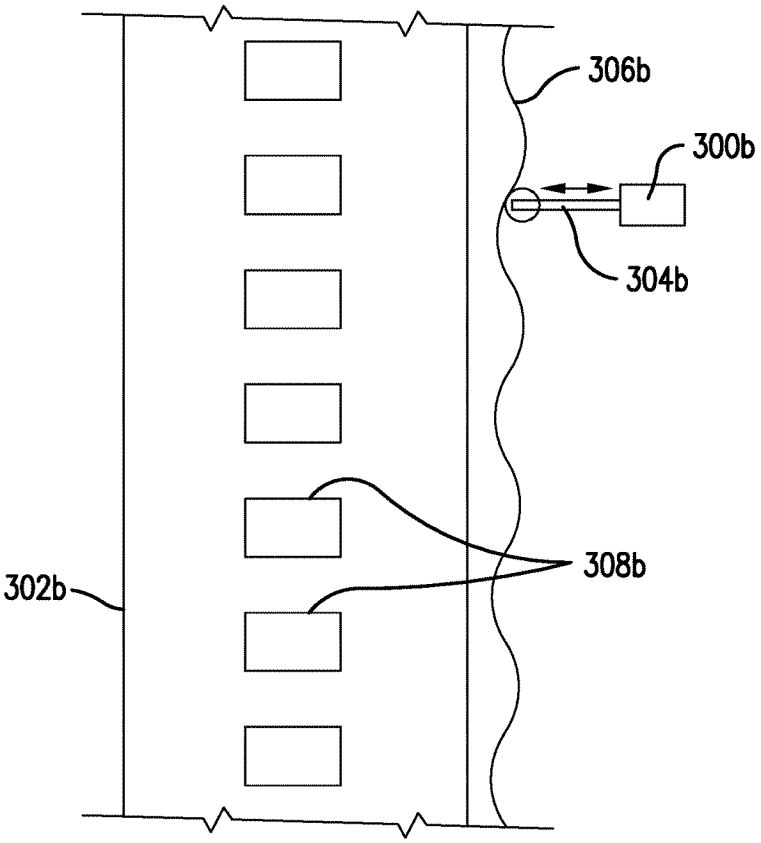
FIG. 12 is a simplified drawing of a limit switch system similar to that of FIG. 11, but employing a vertically varying profile surface other than the downstop pawl to actuate the limit switch.
Figure 11:
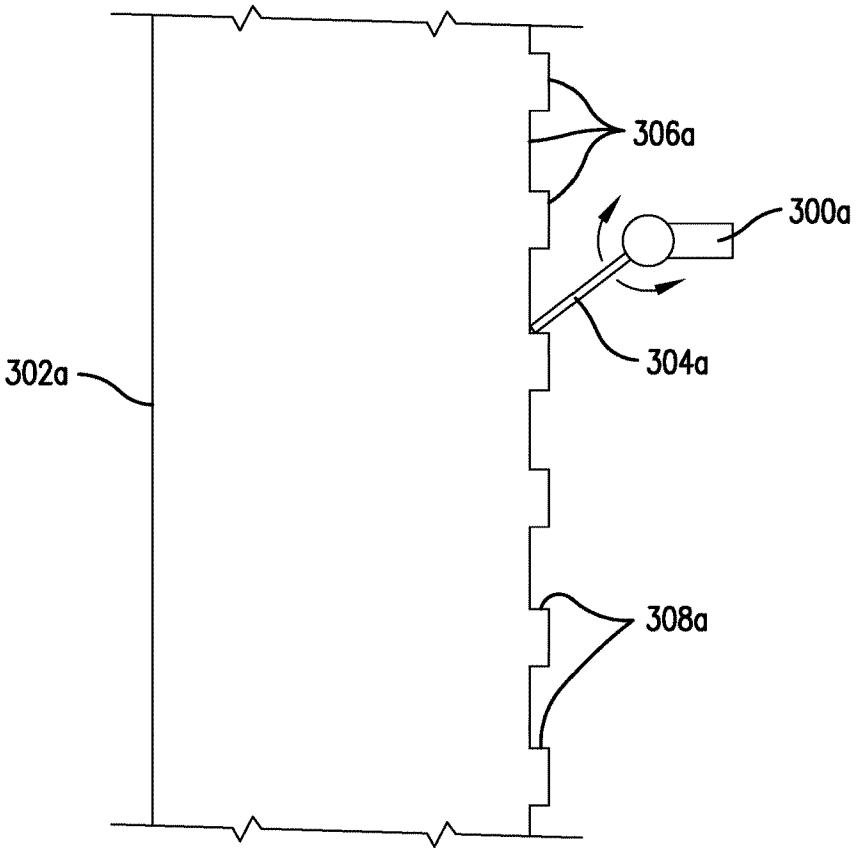
FIG. 11 is a simplified drawing of a limit switch system used to provide an indication of the vertical position of the lift, where the limit switch is actuated by the lift's downstop pawl.

The position sensors 218 depicted in FIG. 10 can be any of a variety of mechanisms for determining the absolute or relative height of the lifts 202. In one embodiment, the position sensors 218 may comprise a string potentiometer. In other embodiments, the position sensors 218 may comprise a limit switch. FIGS. 11 and 12 provide simplified illustrations of possible configurations for lifts 202 and/or lifts 22 equipped with limit switches.

FIGS. 11 and 12 depict two embodiments of limit switch systems suitable for use with the lift systems (i.e., lift system 20 and/or lift system 200) and lifts (i.e., lifts 22 and/or lifts 202) of the present invention. In the embodiment depicted in FIG. 11, the illustrated limit switch system is coupled to the mechanical downstop system of the lift and senses movement of the downstop system as the cradle assembly is raised relative to the post. In the embodiment depicted in FIG. 12, the limit switch includes a shiftable sensing element that is coupled to the cradle assembly 34 and follows along a vertically varying profile surface as the cradle assembly of the lift is raised and lowered relative to the lift's post. These systems are described in more detail below.

FIG. 11 shows a rotational limit switch 300*a* coupled to a downstop pawl 304*a*. In this configuration, as the cradle assembly of the lift raises relative to the post 302*a* of the lift, the movement of the downstop pawl 304*a* caused by passing over a vertically varying profile surface 306*a* defined by the downstop lugs 308*a* activates the limit switch. The rotational limit switch 300*a* can communicate with the electrical control system of the lift so that the electrical control system always knows the vertical position of the cradle assembly relative to the downstop lugs 308*a*.

FIG. 12 shows a linear limit switch 300*b* coupled to a rolling follower 304*b*. In this configuration, as the cradle assembly of the lift is raised and lowered relative to the post 302*b* of the lift, the movement of the rolling follower 304*b* caused by passing over a vertically varying cam surface 306*b* activates the limit switch. The linear limit switch 300*b* can communicate with the electrical control system of the lift so that the electrical control system always knows the vertical location of the cradle assembly relative to the vertically varying cam surface 306*b*. This will allow the electrical control system to determine the vertical location of the cradle assembly relative to the downstop lugs 308*b*.

Although the embodiments depicted in FIGS. 1-12 only show pneumatic lifts, it should be understood that certain aspects of the present invention can be advantageously employed in lifts powered by sources other than pneumatic power. For example, certain aspects of the present invention can be employed in lift systems powered by one of more of a pneumatic actuator, a hydraulic actuator, a pneumatic/hydraulic actuator, and/or an electric actuator. Further, although the embodiments depicted in FIGS. 1-12 show a four lift system, the present invention can be applicable to lift systems employing any number of lifts. For example, the present invention can be employed in a lift system having two, four, six, eight, or ten individual lifts. Also, the present invention can be applicable to lifts other than vehicle lifts.

Embodiments of the present invention may also include one or more methods for retrofitting conventional pneumatic lifts with a lift system control system (e.g., LS control system), such as that described above with respect to the lift systems (i.e., lift system 20 and/or lift system 200) and lifts (i.e., lifts 22 and/or lifts 202). Thus, in certain embodiments of the present invention, there is provided a method of converting a manually-synching pneumatic vehicle lift system into an automatically-synching pneumatic vehicle lift system, with such automatically-synching system described in more detail below. The method can include the following steps: (a) providing a first pair of pneumatic lifts, each comprising a base assembly for supporting the pneumatic lift on the ground, a cradle assembly for engaging a wheel of the vehicle, a pneumatically powered cylinder for raising the cradle assembly relative to the base assembly, and a mechanical downstop assembly for selectively inhibiting unrestricted downward movement of the cradle assembly relative to the base assembly; (b) providing a lift system control system for controlling the pneumatic lifts, where the lift system control system comprises a position indication system (e.g., position sensors), a pneumatic control system, and an electrical control system; and (c) coupling at least a portion of the position indication system to the pneumatic lifts so that the position indication system is configured to provide an indication of the absolute and/or relative height of each cradle assembly.

Conventional control systems for pneumatic lift systems generally include pneumatic valve control signals that incorporate a ratcheting on/off control algorithm. As such, the control systems for such lifts systems are configured to command each lift associated with the pneumatic control systems to lift/lower to a particular height level. The lifts that reach the particular height level first are then instructed to stop at a stationary position and wait for the other lifts to reach the same height level. In more detail, a lift moves upward/downward until the force generated by the air pressure within the lift is balanced by a dynamic friction force and the load, thereby causing the lift to stop. Because the lift has stopped, a static friction force much higher than the dynamic friction force must be overcome to start the lift in motion once again. With pneumatic lifts that use such ratcheting on/off control algorithms, a sufficient amount of air pressure must be supplied to the lifts to overcome the static friction that exists due to the lifts being in the stationary position. Such a sufficient amount of air pressure can cause sudden upward movements of the lift, and further can cause the volume of air within the lift to suddenly increase while suddenly decreasing the air pressure. As can be appreciated by one of ordinary skill in the art, a comparable problem exists in lowering applications of pneumatic lifts. While these ratcheting on/off control algorithms are generally operable to provide for synchronous raising/lowering operations of lifts, the motion of the lifts generally includes unwanted jerky, ratcheting-type actions. As such, the lifts systems incorporating ratcheting on/off control algorithms do not provide for a smooth, consistent operation.

Embodiments of the present invention provide enhancements over such ratcheting on/off control algorithms by providing a lift system control system that incorporates a pulse-width control signal via a pulse-width control logic algorithm. Such a lift system control system may be incorporated with the pneumatic lift systems 20 and associated pneumatic lifts 22 and/or pneumatic lift systems 200 and associated pneumatic lifts 202, as were described above. Nevertheless, for conciseness, the following description of the pulse-width control of embodiments of the present invention will be described with respect to the pneumatic lift system 20 and the associated pneumatic lifts 22. Furthermore, the pulse-width control may be implemented remotely from each lift, such as via the handheld wireless control module 30, or internally within each individual lift 22, such as via the electrical control systems of each lift 22. For conciseness, the following description will be described with respect to the pulse-width control logic being implemented via the electrical control system of each of the lifts 22. In some embodiments, the pulse-width control logic algorithm will be implemented via a computer program associated with the electrical control system. The computer program may be in the form a plurality of code segments, steps, or instructions stored on a computer-readable storage medium and executable by a processing element of the electrical control system.

In more detail, embodiments of the present invention provide for the pneumatic lift system 22 to include an algorithm that utilizes pulse-width control logic within the electrical control system. Advantageously, the pulse-width control logic implemented by the electrical control system prohibits each individual lift 22 of the lift system 20 from completely stopping during raising and lowering operations. By prohibiting each of the lifts 22 from completely stopping, such lifts 22 will not have a static friction factor to overcome. As such, embodiments of the present invention provide for the ability to control height adjustments more precisely, thus, resulting in synchronized lifts 22 that have smooth and uninterrupted lifting and lowering motions. To accomplish such motion, the electrical control system instructs air to be metered into or out of the main cylinder 134 of each lift 22, via the pneumatic control system, according to a pulse-width control logic algorithm, also described as a "duty-cycle" algorithm. In particular, the electrical control system may be configured to determine and specify, via the duty-cycle algorithm, the amount of air being forced into or out of the main cylinder 134 of an associated lift 22, resulting in the ability to carefully control the rate at which the lift 22 is being raised or lowered. The result is a smoother and more precise ability to synchronize the lifts 22 of the lift system 20.

In more detail, embodiments of the present invention provide for the electrical control system instruct the pneumatic control system via a pulse width modulated (PWM) signal, with such PWM signal having a calculated duty cycle. A specific PWM signal is sent to a pneumatic control valve, e.g., raise valve 104 and/or lower valve 108, which is/are operably connected to the pneumatic main cylinder 134 of a given lift 22 of the lift system 22. Exemplary PWM signals are illustrated in FIGS. 13*a*-13*d*. As illustrated each signal includes a period T, over which the signal repeats. Within each period T, the PWM signal includes an "on" signal 310 and/an "off" signal 320. Such a signal may be interpreted as a digital signal having two voltage levels, high and low, which can represent the Boolean values 1 ("on" signal 310) and 0 ("off" signal 320). The percentage of the period T in which the "on" signal 310 is present is defined as the "duty cycle." For example, in FIGS. 13*a*-13*d*, the illustrated duty cycles are approximately 100%, 75%, 50%, and 25%, respectively. The period T for the PWM signal is preferably adapted as necessary for a particular lift 22 and/or for a particular main cylinder 134 of a lift 22. In some embodiments, the period T may be less than about 5 seconds, less than 3 seconds, less than 2 seconds, less than 1 second, or less than 0.5 seconds. In addition, as will be described in more detail below, it is required that the duration of the "off" signal 320 be short enough that the lift 22 does not come to a complete stop. As such, embodiments of the present invention may provide for the duration of the "off" signal 320 of each period T to be less than about 2 seconds, 1 second, 0.5 seconds, 0.2 seconds, or 0.1 seconds.

Given the PWM signal described above, the electrical control system is configured to control the one or more pneumatic valves (e.g., raise valve 104 and/or lower valve 108) associated with the main cylinders 134 of each of the lifts 22 of the lift system 20. In particular, the "on" signal 310 of the PWM signal instructs the pneumatic valves to open, thereby allowing air to enter or exit the main cylinders 134. As such, a greater the duty cycle (i.e., having a larger portion of the period T of the PWM signal comprised by the "on" signal 310), the longer the pneumatic valves are "on" or open per period T. When performing a raising operation with a lift 22, the "on" signal 310 directs the lift's 22 pneumatic valve to open, such that the pneumatic valve allow more air into the lift's main cylinder 134, resulting in a faster raising motion. Alternatively, when performing a lowering operation with a lift 22, the "on" signal 310 directs the lift's 22 pneumatic valve to open, such that the pneumatic valve allows more air to escape the lift's 22 main cylinder, resulting in a faster lowering motion. In contrast, the smaller the duty cycle (i.e., having a smaller portion of the period T of the PWM signal comprised by the "on" signal 310), the shorter the lift's 22 pneumatic valve is "on" or open per period T. As such, the amount of air allowed into or out of the lift's pneumatic cylinder 134 is reduced, thereby resulting in a slower raising or lowering motion.

It is important to note that during raising and lowering operations, the electrical control system of the present invention is always directly or indirectly controlling the pneumatic control valves with a PWM signal. The electrical control system of embodiments of the present invention is operable to control each of the lifts 22 of the lift system 20 by determining and sending a unique PWM signal to each lift 22. Furthermore, the PWM signal used during raising and lower operations always includes a non-zero duty cycle, such that the lift's 22 cylinder 134 being controlled is never allowed to come to a complete stop. By ensuring the continuous motion of the lift's 22 main cylinder 134, the problem of overcoming static friction during a synchronous raising lowering operation of the lift system 20 can be eliminated.

Synchronization between the lifts 22 of the lift system 20 is ultimately achieved by adjusting the duty cycles of each of the PWM signals provided to the main cylinders 134 of each of the lifts 22. Such an adjustment can be made in real time. As should be appreciated, the rate/speed at which each of the lifts' main cylinders 134 are raised and lowered can be adjusted by altering the duty cycles provided to the pneumatic valves of the main cylinders 134 of the lifts 22. For instance, during raising/lowering operation of a lift system 20 that includes a plurality of individual lifts 22, the electrical control system will obtain height information for each of the cradle assemblies 34 of the individual lifts 22 in the lift system 20. For clarity, general references to the heights of the lifts 22, as used herein, specifically refer to the heights of the cradle assemblies 34 of the lifts 22.

The height information may be obtained via the height sensor for each lift. The height information may be sampled from each lift 22 at a given height sampling frequency. For instance, the height sampling frequency may be every 1 second, every 0.5 second, every 0.2 second, every 0.1 second, every 0.01 second, or less. For each sampling of height information, the actual or relative heights of the lifts 22 in the lift system 20 are compared. Based on the comparison of the heights, an error result for each particular lift 22 in the lift system 20 is determined. The error result for a particular lift 22 comprises a height difference between the particular lift 22 and the lift 22 with the highest or lowest position. Specifically, during raising operations, the error result is determined to be the height difference between the particular lift 22 and the lift 22 with the lowest position. Contrastingly, during lower operations, the error result is determined to be the height difference between the particular lift 22 and the lift with the highest position.

It may be noted that the set of all of the error results for all of the lifts 22 in the lift system 20 should fit within an error boundary defined as the maximum height difference between the highest lift 22 and the lowest lifts 22. Since all of the remaining lifts will have a height difference that is less than the maximum height difference, all of the remaining error results will fit within the error boundary. In some embodiments, the electrical control system may determine changes in the duty cycle based on such an error boundary. Furthermore, it should be understood that any determined error result corresponds to one of the lifts 22 being raised or lowered at a faster rate (i.e., faster speed) than another lift 22 in the lift system 20. As such, to synchronize the rate at which each of the lifts 22 are being raised or lowered, the speeds at which the lifts 22 are being raised or lowered must be altered.

Specifically, the speed at which a given lift 22 is being raised or lowered is altered by varying the duty cycle of the PWM signal used to control the pneumatic valve associated with main cylinder 134 of the lift 22. The improved pulse-width control logic algorithm of the present invention utilizes real-time duty cycle adjustments for controlling the pneumatic valves. As described above, the PWM signals can be sent from the pneumatic control system or the electrical control system of the lifts 22, depending on how the lift system 20 is configured. In particular, the speed of each lift 22 is caused to match the speed of the slowest lift 22 in the lift system 20. The speed of a particular lift is slowed by the reducing the duty cycle of the PWM signal used to control the pneumatic valve associated with the main cylinder 134 of the lift 22. By reducing the duty cycle, the amount of time the "on" signal 310 occupies during each period T is reduced, thereby reducing the flow rate of air into or out of the main cylinder 134 and causing the lift 22 to raise or lower more slowly. However, the lifts 22 that are slowed to maintain synchronization are never allowed to come to a complete stop. Instead, the duty cycle is always non-zero, such that the lifts 22 are slowed until all of the lifts 22 in the lift system 20 are synchronized (i.e., each lift has a zero magnitude error result).

FIG. 13 illustrates the logic flow of the pulse-width control algorithm being implemented to lower a lift 22 of a lift system 20. When lowering a lift 22 of a lift system 20 utilizing the improved synchronized control logic of embodiments of the present invention, a method 400, which includes the below-stated steps, may be performed for each lift 22. A first step 402 includes checking the heights of all of the lifts 22 in the lift system 20. A next step 404 includes comparing the height of a particular lift 22 to the heights of all of the other lifts 22 in the lift system 20 and determining the highest lift 22 in the lift system 20. A next step 406 includes determining a necessary adjustment to the duty cycle for the pneumatic valve of the main cylinder 134 of the particular lift 22. Such an adjustment may be determined by calculating an error result, which is the height difference between the particular lift 22 and the highest lift 22. A next step 408 may include adjusting the pneumatic valve output for the main cylinder 134 of the particular lift 22 based on the necessary duty cycle adjustment determined in step 406. As should be understood, to facilitate synchronization of the lifts 22 of the lift system 20, a greater error result (i.e., a greater height difference between the particular lift 22 and the highest lift 22) would correspond to a greater decrease in the duty cycle of the PWM signal. Such a decrease in the duty cycle would provide a greater slowing of the particular lift 22, such that the lifts 22 of the lift system 20 can quickly synchronize. A final step 410 includes performing an operational error check throughout the lift system 20 for any operational errors that may prevent safe operation of the lifts 22 of the lift system 20. In the event an operation error is detected in the lift system, all lifts 22 in the lift system 20 are caused to stop (e.g., by providing a 0% duty cycle) and an error message is displayed (e.g., on the display of the control module 30). In the event an operational error is not detected in the lift system 20, a valid command to continue lowering the lift 22 is checked to be present. If a valid command is present, the particular lift 22 is continued to be lowered, and the method 400 returns to step 404 to repeat. It is understood that steps 404 to 410 may be completed any number of times, as may be required to completely lower all of the lifts 22 of the lift system 20. Furthermore, the steps 404 to 410 may repeat quickly, such as at the sampling frequency discussed above. If a valid command is not present the particular lift 22 does not continue to be lowered, and the lift system 20 is stopped.

As an example, a lift system 20 may include two individual lifts 22 configured to lower one end of a vehicle. If during the lowering operation, one of the lifts 22 begins to lag behind the other lift (i.e., a first lift 22 is higher than an other second lift 22), the lifts 22 will be out of sync, such that the vehicle may begin to tip or tilt and become unsafe. Regardless, embodiments of the present invention provide for the lifts 22 of the lift system 20 to synchronize, as described above. In particular, the electrical control system determines the height difference between the two lifts and alters the valve control signal (i.e., the PWM signal) for the second lift 22 by reducing the duty cycle of the signal so that the second lift 22 slows down and synchronizes with the first lift 22. It should be understood that such a concept is equally applicable to a lift system 20 having more than two lifts 22. For instance, a lifts system 20 having four lifts 22 could be used to lower both ends of the vehicle in a synchronous manner.

FIG. 14 illustrates the logic flow of the synchronized control algorithm when raising a lift 22 of a lift system 20. When raising a lift 22 of a lift system 20 utilizing the improved synchronized control logic of embodiments of the present invention, a method 500, which includes the below-stated steps, may be performed for each lift 22 in the lifts system 20. A first step 502 includes checking the heights of all of the lifts 22 in the lift system 20. A next step 504 includes comparing the height of a particular lift 22 to the heights of all of the other lifts 22 in the lift system 20 and determining the lowest lift 2 in the lift system 20. A next step 506 includes determining a necessary adjustment to the duty cycle for the pneumatic valve of the main cylinder 134 of the particular lift 22. Such an adjustment may be determined by calculating an error result, which is the height difference between the particular lift 22 and the lowest lift 22. As should be understood, to facilitate synchronization of the lifts 22 of the lift system 20, a greater error result (i.e., a greater height difference between the particular lift 22 and the lowest lift 22) would correspond to a greater decrease in the duty cycle of the PWM signal. Such a decrease in the duty cycle would provide a greater slowing of the particular lift 22, such that the lifts 22 can quickly synchronize. A final step 510 includes performing an operational error check throughout the lift system 20 for any operational errors that may prevent safe operation of the lifts 22 of the lift system 20. In the event an operation error is detected in the lift system 20, all lifts 22 in the lift system 20 are caused to stop (e.g., by providing a 0% duty cycle) and an error message is displayed. In the event an operational error is not detected in the lift system 20, a valid command to continue raising the lift 22 is checked to be present. If a valid command is present, the particular lift 22 is continued to be raised, and the method 500 returns to step 504 to repeat. It is understood that steps 504 to 510 may be completed any number of times, as may be required to completely raise all of the lifts 22 of the lift system 20. Furthermore, the steps 504 to 510 may repeat quickly, such as at the sampling frequency discussed above. If a valid command is not present the particular lift 22 does not continue to be raised, and the lift system 20 is stopped.

As an additional example, a lift system 20 may include two individual lifts 22 configured to raise one end of a vehicle. If during the raising operation, one of the lifts 22 begins to lag behind the other lift (i.e., a first lift 22 is lower than an other second lift 22), the lifts 22 will be out of sync, such that the vehicle may begin to tip or tilt and become unsafe. Regardless, embodiments of the present invention provide for the lifts 22 of the lift system 20 to synchronize, as described above. In particular, the electrical control system determines the height difference between the two lifts and alters the valve control signal (i.e., the PWM signal) for the second lift 22 by reducing the duty cycle of the signal so that the second lift 22 slows down and synchronizes with the first lift 22. It should be understood that such a concept is equally applicable to a lift system 20 having more than two lifts 22. For instance, a lifts system 20 having four lifts 22 could be used to raise both ends of the vehicle in a synchronous manner. As such, the lift system 20 could lift all of the vehicle's wheels off the ground, by as much as 2 feet, 3 feet, 4 feet, 6 feet, or more.

Once each of the lifts 22 in the lift system 20 has reached its intended position, the electrical control system instructs the lifts to remain at such an intended position. As should be apparent, such an instruction may be in the form of sending a PWM signal to the pneumatic valves of the main cylinders 134 of each of the lifts 22, with such PWM signal having a 0% duty cycle corresponding to the "off" signal 320 being provided for the entire period T.

Although the invention has been described with reference to the preferred embodiment illustrated in the attached drawing figures, it is noted that equivalents may be employed and substitutions made herein without departing from the scope of the invention as recited in the claims.

What is claimed is:

1. A self-synchronizing wheel lift system configured to lift a vehicle using compressed air, said lift system comprising:

a plurality of pneumatic wheel lifts; and a lift control system programmed to automatically synchronize the heights of said wheel lifts during vehicle lifting without causing any of said wheel lifts to completely stop during vehicle lifting, wherein each wheel lift includes a pneumatic three-way valve for controlling actuation of said wheel lift, wherein said lift control system comprises an electrical control system programmed to generate a pneumatic three-way valve control signal for each of said wheel lifts in said lift system, wherein each valve control signal comprises a pulse-width modulated signal that includes a period T, wherein for each period T said pulse-width modulated signal includes one on portion and one off portion.

2. The wheel lift system of claim 1, wherein the lift control system is configured to automatically synchronize the heights of said wheel lifts during vehicle lowering without causing any of said wheel lifts to completely stop during vehicle lowering.

3. The wheel lift system of claim 1, wherein the lift control system further comprises a position indication system and a pneumatic control system, wherein said position indication system is configured to provide an indication of the heights of said wheel lifts during vehicle lifting, wherein said pneumatic power control system is configured to control the flow of compressed air to said wheel lifts during lifting, and wherein said electrical control system is configured to control said pneumatic control system based on said indication of the heights provided by said position indication system.

4. The wheel lift system of claim 3, wherein each of said wheel lifts comprises a pneumatic main cylinder, wherein said pneumatic control system comprises said pneumatic three-way valves each associated with one of said main cylinders, wherein each of said pneumatic three-way valves is configured to control air flow into and/or out of one of said main cylinders.

5. The wheel lift system of claim 4, wherein said electrical control system is configured to generate the valve control signal for each of said three-way pneumatic valves, wherein each of said pneumatic three-way valve control signals controls the position of one of said pneumatic three-way valves, and wherein said electrical control system is configured to adjust said pneumatic three-way valve control signals based on said indication of heights provided by said position indication system.

6. The wheel lift system of claim 5, wherein said pneumatic three-way valve control signals shift said pneumatic three-way valves into an on position during said on portion and into an off position during said off portion.

7. The wheel lift system of claim 6, wherein said electrical control system is configured to control the speed of each of said wheel lifts by changing the relative duration of said on portion and said off portion of said pneumatic three-way valve control signals.

8. The wheel lift system of claim 6, wherein said electrical control system is configured to limit the duration of said off portions of said pneumatic three-way valve control signals to prevent any of said wheel lifts from completely stopping while said vehicle is being lifted.

9. The wheel lift system of claim 3, wherein said electrical control system is a wireless control module configured to communicate wirelessly with each of the wheel lifts in the wheel lift system.

10. The wheel lift system of claim 9, wherein said position indication system includes a plurality of position sensors, with each wheel lift in said wheel lift system including at least one position sensor, and wherein said position indication system is configured to communicate wirelessly with said wireless control module.

11. The wheel lift system of claim 10, wherein said position sensors comprise string potentiometers.

12. The wheel lift system of claim 1, wherein said wheel lift system comprises at least four wheel lifts.

* * * * *